US008157123B2

(12) United States Patent
Tucker et al.

(10) Patent No.: US 8,157,123 B2
(45) Date of Patent: Apr. 17, 2012

(54) CONTAINER

(75) Inventors: Edward B. Tucker, Yorkville, IL (US); Anand Ramanujam, Arlington Heights, IL (US); Lawrence John Racana, Willowbrook, IL (US); Ares Marasligiller, Cincinnati, OH (US); Jason Phillips, Cincinnati, OH (US); Yashodhan Dhuru, Cincinnati, OH (US); Gordon D. Thomas, Mason, OH (US); Scott Zieker, Cincinnati, OH (US)

(73) Assignee: The Glad Products Company, Oakland, CA (US)

( * ) Notice: Subject to any disclaimer, the term of this patent is extended or adjusted under 35 U.S.C. 154(b) by 721 days.

(21) Appl. No.: 11/064,868

(22) Filed: Feb. 23, 2005

(65) Prior Publication Data

US 2007/0007298 A1 Jan. 11, 2007

(51) Int. Cl.
*B65D 41/18* (2006.01)

(52) U.S. Cl. ..... 220/789; 220/4.21

(58) Field of Classification Search ..... 220/4.21, 220/4.24, 780, 787, 789, 791, 793
See application file for complete search history.

(56) References Cited

U.S. PATENT DOCUMENTS

| | | | | | |
|---|---|---|---|---|---|
| 2,868,410 | A | * | 1/1959 | Henchert | 220/787 |
| 3,198,375 | A | * | 8/1965 | Hunter | 222/566 |
| 3,458,079 | A | * | 7/1969 | Gasbarra | 220/787 |
| 3,516,572 | A | * | 6/1970 | Davis | 220/781 |
| 3,931,890 | A | | 1/1976 | Davis | |
| 4,076,123 | A | | 2/1978 | Davis | |
| 4,275,815 | A | | 6/1981 | Davis | |
| 4,335,827 | A | * | 6/1982 | Knize et al. | 220/284 |
| 4,421,244 | A | | 12/1983 | Van Melle | |
| 4,474,305 | A | * | 10/1984 | Marco | 220/787 |
| 4,679,699 | A | * | 7/1987 | Malsbury et al. | 220/789 |
| 4,703,857 | A | | 11/1987 | Jahnen et al. | |
| 4,747,510 | A | | 5/1988 | Mack | |
| 4,765,501 | A | * | 8/1988 | Kao | 220/4.21 |
| 4,836,407 | A | * | 6/1989 | Bruce et al. | 220/276 |
| 4,877,151 | A | | 10/1989 | Rush et al. | |
| 4,896,184 | A | | 1/1990 | Kamitamari et al. | |
| 5,253,781 | A | | 10/1993 | Van Melle et al. | |
| 5,377,860 | A | | 1/1995 | Littlejohn et al. | |
| 5,385,255 | A | | 1/1995 | Varano et al. | |
| 5,419,451 | A | | 5/1995 | Bitel, Jr. | |
| 5,507,406 | A | * | 4/1996 | Urciuoli et al. | 220/269 |
| 5,692,617 | A | | 12/1997 | Adams | |

(Continued)

FOREIGN PATENT DOCUMENTS

WO WO 2004/049866 A1 6/2004

(Continued)

*Primary Examiner* — Anthony Stashick
*Assistant Examiner* — James N Smalley
(74) *Attorney, Agent, or Firm* — David Peterson

(57) ABSTRACT

The container includes a base and a detachable cover. To releasably attach the base and cover, the base includes a first closure portion and the cover includes an engagable second closure portion. In one aspect, the first and second closure portions are configured for engagement in both a fully engaged position and an intermediately engaged position. In the intermediately engaged position, the container can be further configured to vent steam during, for example, microwaving. In another aspect, the container including the first and second closure portions can be configured for simplified engagement of the base and cover, preferably by enabling engagement via a downward push applied to the center of the cover. In yet another aspect, the first and second closure portions can be configured with diverging flanges that simplify detachment of the base and cover.

16 Claims, 30 Drawing Sheets

U.S. PATENT DOCUMENTS

| | | | | |
|---|---|---|---|---|
| 5,881,880 | A | 3/1999 | Jacques et al. | |
| 5,979,690 | A | 11/1999 | Hartley | |
| 6,032,827 | A | 3/2000 | Zettle et al. | |
| 6,047,851 | A | 4/2000 | Freek et al. | |
| 6,056,138 | A * | 5/2000 | Chen | 220/4.21 |
| 6,170,696 | B1 * | 1/2001 | Tucker et al. | 220/793 |
| 6,170,969 | B1 | 1/2001 | Dumse | |
| 6,460,716 | B1 * | 10/2002 | Wong | 220/4.24 |
| 6,467,647 | B1 | 10/2002 | Tucker et al. | |
| 2004/0245261 | A1 | 12/2004 | Stanos et al. | |
| 2005/0230406 | A1 * | 10/2005 | Maravich et al. | 220/792 |

FOREIGN PATENT DOCUMENTS

| | | | |
|---|---|---|---|
| WO | WO 2004/049867 | A1 | 6/2004 |
| WO | WO 2004/049880 | A1 | 6/2004 |
| WO | WO 2004/050513 | A2 | 6/2004 |
| WO | WO 2005/002409 | A1 | 1/2005 |

* cited by examiner

CONTAINER

FIELD OF THE INVENTION

This invention pertains to containers in general and, more particularly, to disposable containers for storing items such as food.

BACKGROUND OF THE INVENTION

The use of various types of semi-rigid, thermoplastic containers for storing and transporting food items is well known. An example of one suitable type of container is provided in U.S. Pat. No. 6,170,696, herein incorporated by reference in its entirety. A container of this design is relatively inexpensive and therefore can be readily disposed of after use without causing a significant monetary outlay. However, this container is also specially adapted for improved durability and sealing and may further be microwavable, freezable, and dishwasher safe. Hence, the container of the disclosed type is much more versatile and may be reused for at least a limited time.

Typically, containers of both the aforementioned type and other types include both a base portion defining a cavity or storage area and a cover portion attachable to the base to open and close the storage area. To physically attach and detach the base and cover, both the base and cover include engageable closure portions extending about their peripheral edges. It is important that engagement between the closure portions be sufficiently secure so that unintentional detachment of the cover from the base is prevented. To preserve the food items and prevent spillage, it is furthermore important that the closure portions engage in such a manner as to create a sufficiently leak-free seal. However, it is also desirable that engagement of the closure portions occur without great difficulty or require excessive effort.

BRIEF SUMMARY OF THE INVENTION

The invention provides a container for storing and transporting food items. The container includes a base defining a cavity and a cover attachable to the base to enclose the cavity. To engage the base and cover, the base includes about its periphery a first closure portion and the cover includes a second closure portion that is engagable with the first closure portion. The container can be made from a thermoplastic material and can be simultaneously characterized as being disposable and as being reusable.

In an aspect of the invention, the first and second closure portions are each formed as generally U-shaped structures with at least two adjacent cutback portions disposed into a leg of the U-shaped closure portion. When engaged, the cutback portions on the second closure portion can align with and abut against the cutback portions on the first closure portion to interlock the base and cover thereby sealing the container. An advantage of forming two adjacent cutback portions on each of the closure portions is that the closure portions can provide a double tactile or audible indication of engagement. Another advantage of having two cutback portions per closure portion is that the base and cover can be placed into an intermediately engaged position. The closure portions can include further features that facilitate microwaving when the base and cover are engaged in the intermediate position.

In another aspect of the invention, the first and second closure portions can be configured to simplify attachment of the base and cover, for example, by enabling engagement of the base and cover by application of a downward engagement force to the center of the cover. To enable engagement via application of a downward force to the center of the cover, the first and second closure portions include various features such as a single cutback portion formed on an inner wall of each generally U-shaped closure portion.

In another aspect of the invention, the first and second closure portions can be provided with sealing portions to interlock and seal the container and with outwardly directed flanges. When the base and cover are engaged, the flanges provide outwardly directed diverging legs. To detach the base and cover, a user can insert his or her fingers between the diverging legs to grip and pull the closure portions apart. Hence, container is easier to open and can be formed without a separate gripping tab as is typically provided for removing the cover from the base.

In addition to the foregoing, additional features and advantages of the invention will be apparent from the detailed description and drawings.

DETAILED DESCRIPTION OF THE EMBODIMENTS

Figure 1:
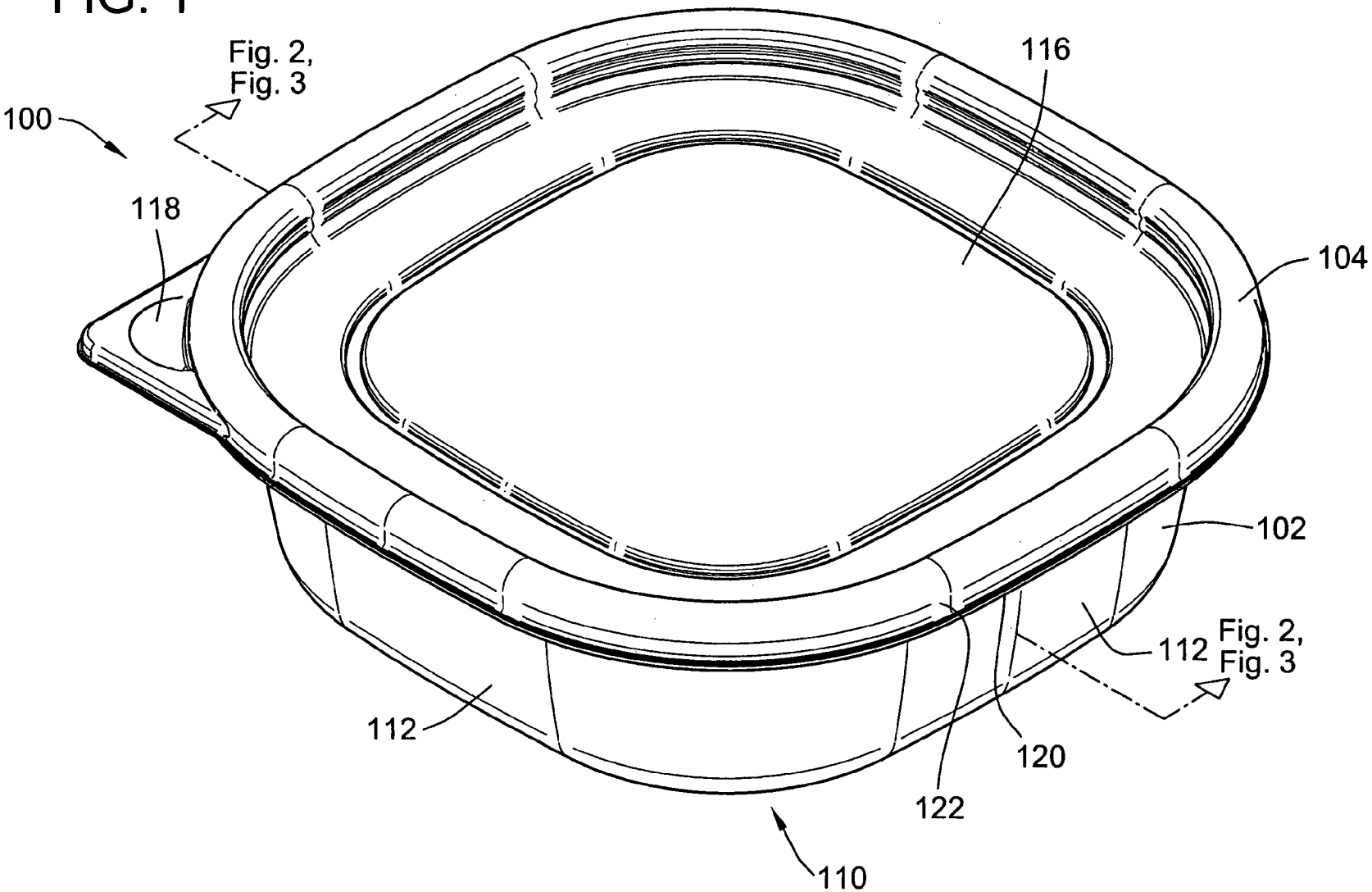
FIG. 1 is a top perspective view of an embodiment of a container having a base and an attached cover designed in accordance with the teachings of the invention.
Figure 2:
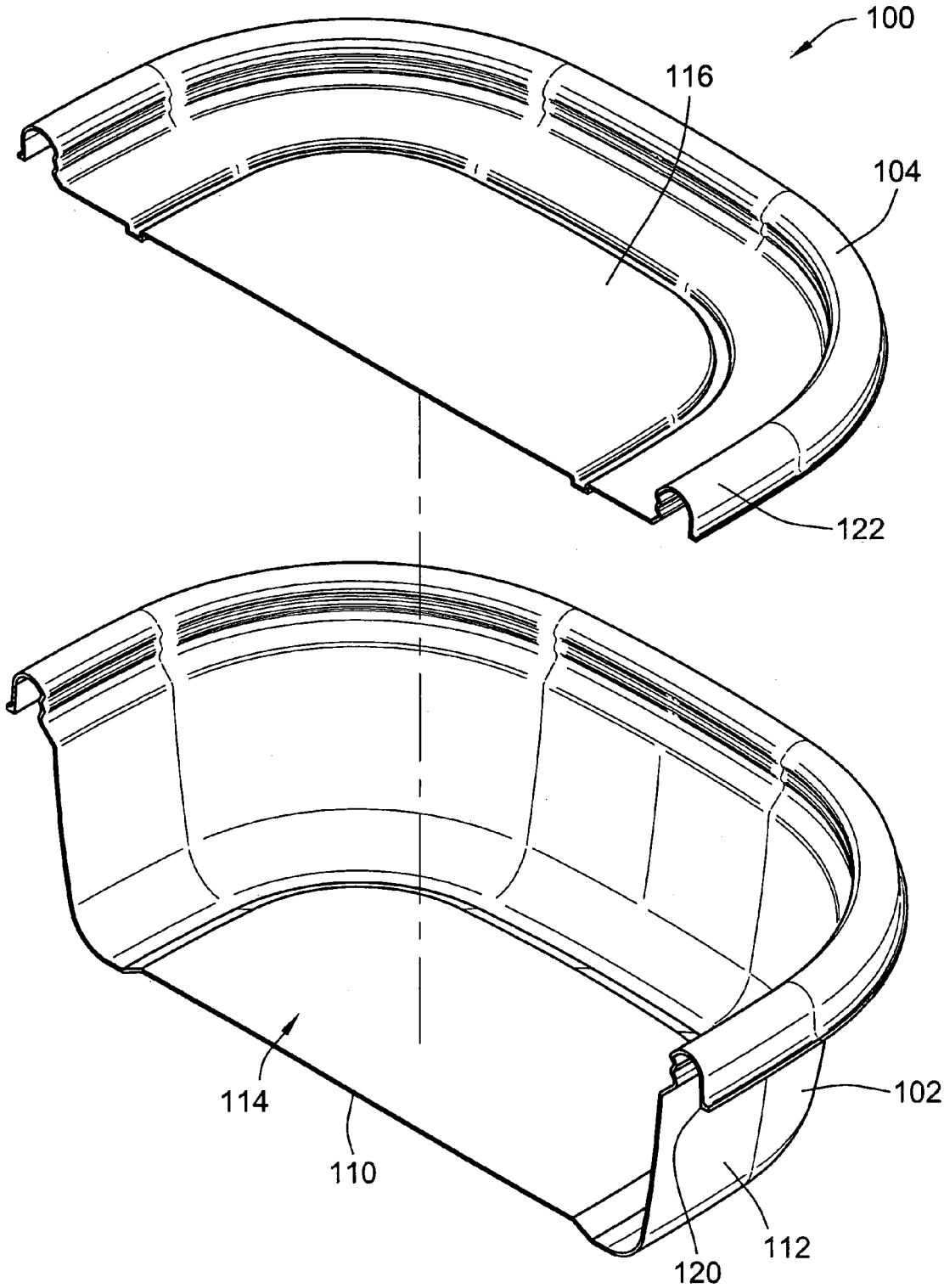
FIG. 2 is a perspective, cross-sectional view taken along line 2-2 of FIG. 1 illustrating the cavity defined by the base and the detached cover.
Figure 3:
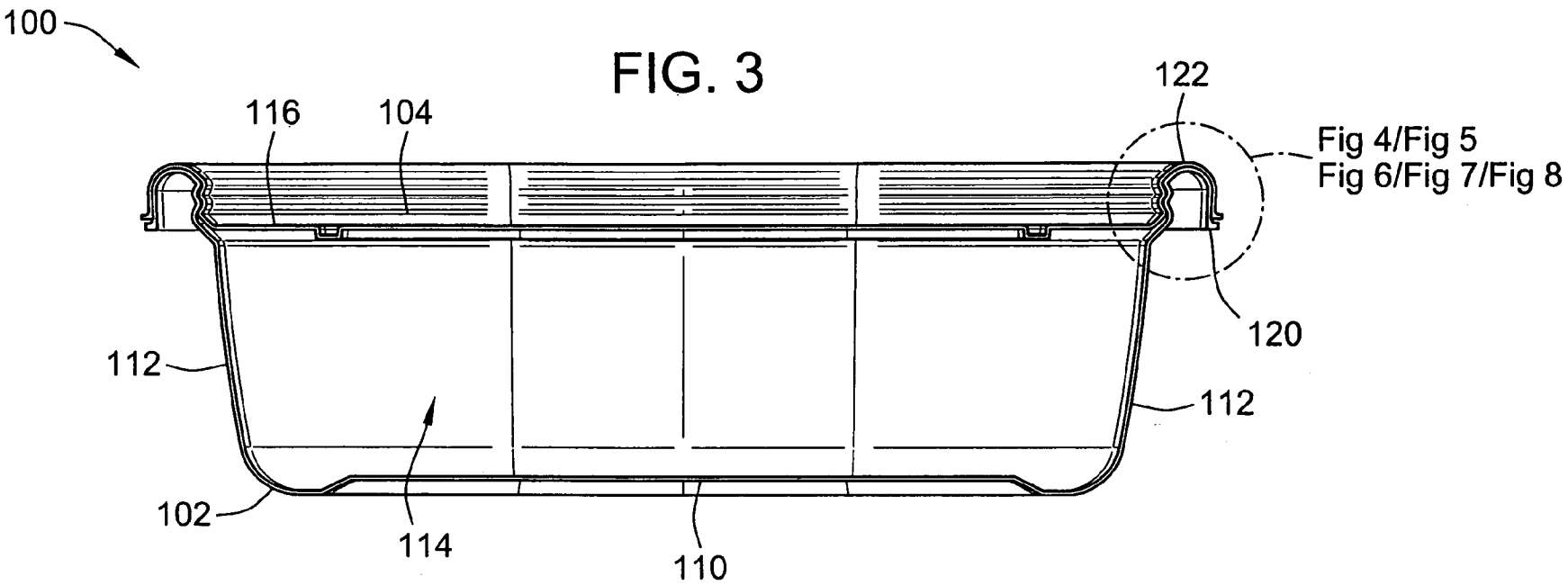
FIG. 3 is a side elevational view of the cross-section taken along line 2-2 of FIG. 1 illustrating the base and cover attached by engagable closure portions.

Now referring to the drawings, wherein like reference numbers refer to like elements, there is illustrated in FIGS. 1 and 2 a container 100 for storing and transporting food items. The container 100 includes a base 102 having a bottom surface 110 and, in the illustrated embodiment, four upright side surfaces 112 extending from the bottom surface and arranged orthogonally with each other to form a square. Of course, in other embodiments, the number and arrangement of the side surfaces 112 can differ. For example, as will be readily appreciated, a single, cylindrically-shaped side surface can extend from the bottom surface. In any arrangement, the bottom surface 110 and side surfaces 112 can be integrally joined by molding to define a cavity 114 that functions as a storage area into which food items can be placed.

To enclose the cavity or storage space 114, the container 100 also includes a detachable cover 104. In the illustrated embodiment, the cover 104 is generally formed as a flat tray having a horizontal surface 116 and a square shape that corresponds to the square shape of the base 102. Furthermore, the cover 104 is completely separable from the base 102. However, in other embodiments, the cover 104 can have any shape corresponding to the shape of the base 102 and can be hingedly connected to the base for articulation between opened and closed positions. To assist in removing the cover 104 from the base 102, the cover can include a removal tab 118 projecting horizontally from a corner.

To releasably attach the base 102 and cover 104 together, the base and cover are provided with respective engagable first and second closure portions 120, 122. The first closure portion 120 is formed at and extends about the peripheral edge of the base 102 defined by the upright side surfaces 112 while the second closure portion is formed at and extends about the correspondingly shaped, peripheral edge of the cover 104. As will be appreciated by FIGS. 1 and 2, the first and second closure portions 120 and 122 are engaged by aligning and pressing together the base 102 and cover 104.

Figure 4:
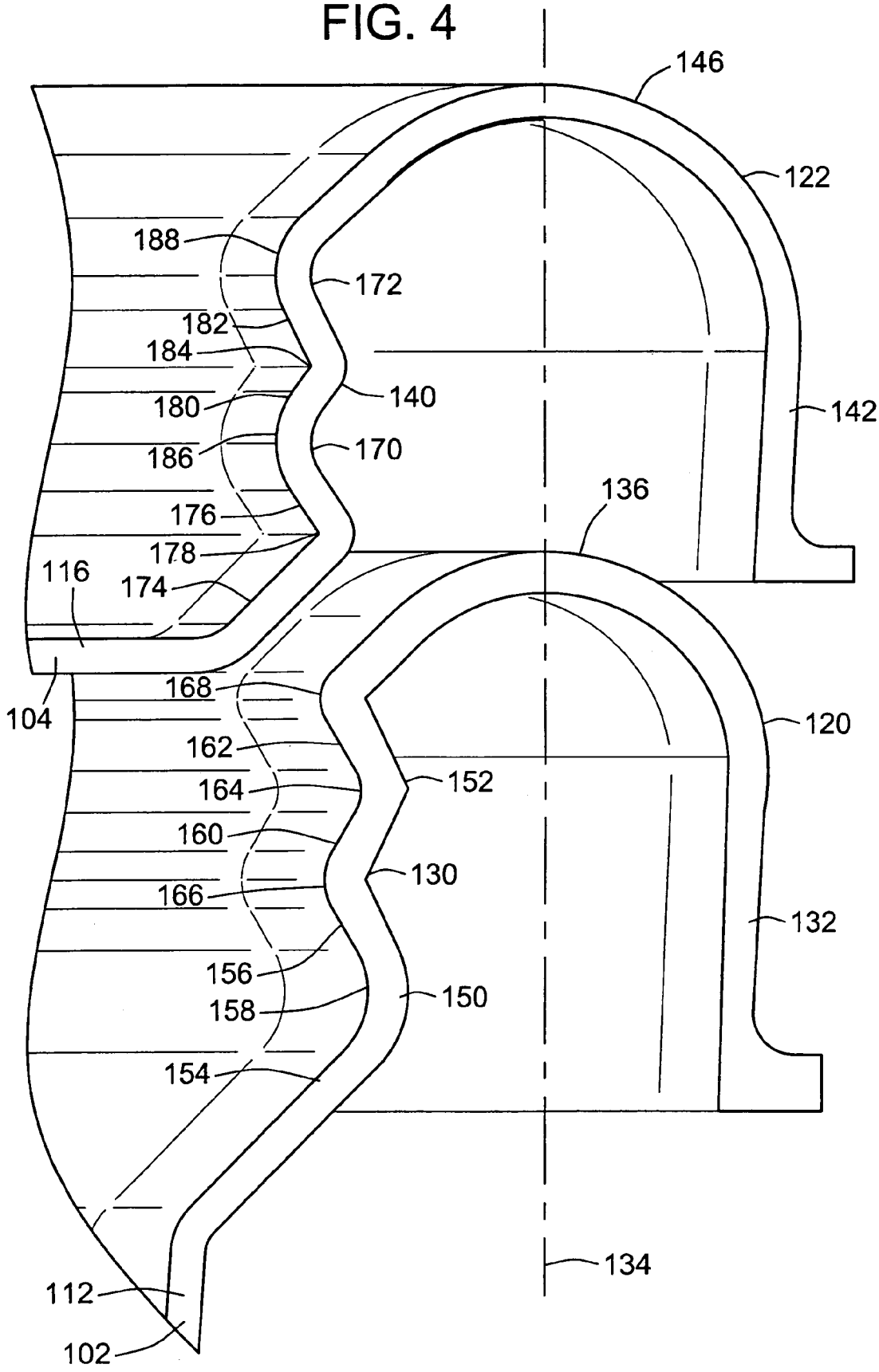
FIG. 4 is a detailed view of the area indicated in FIG. 3 illustrating an embodiment of the first and second closure portions disengaged and separated from each other.
Figure 5:
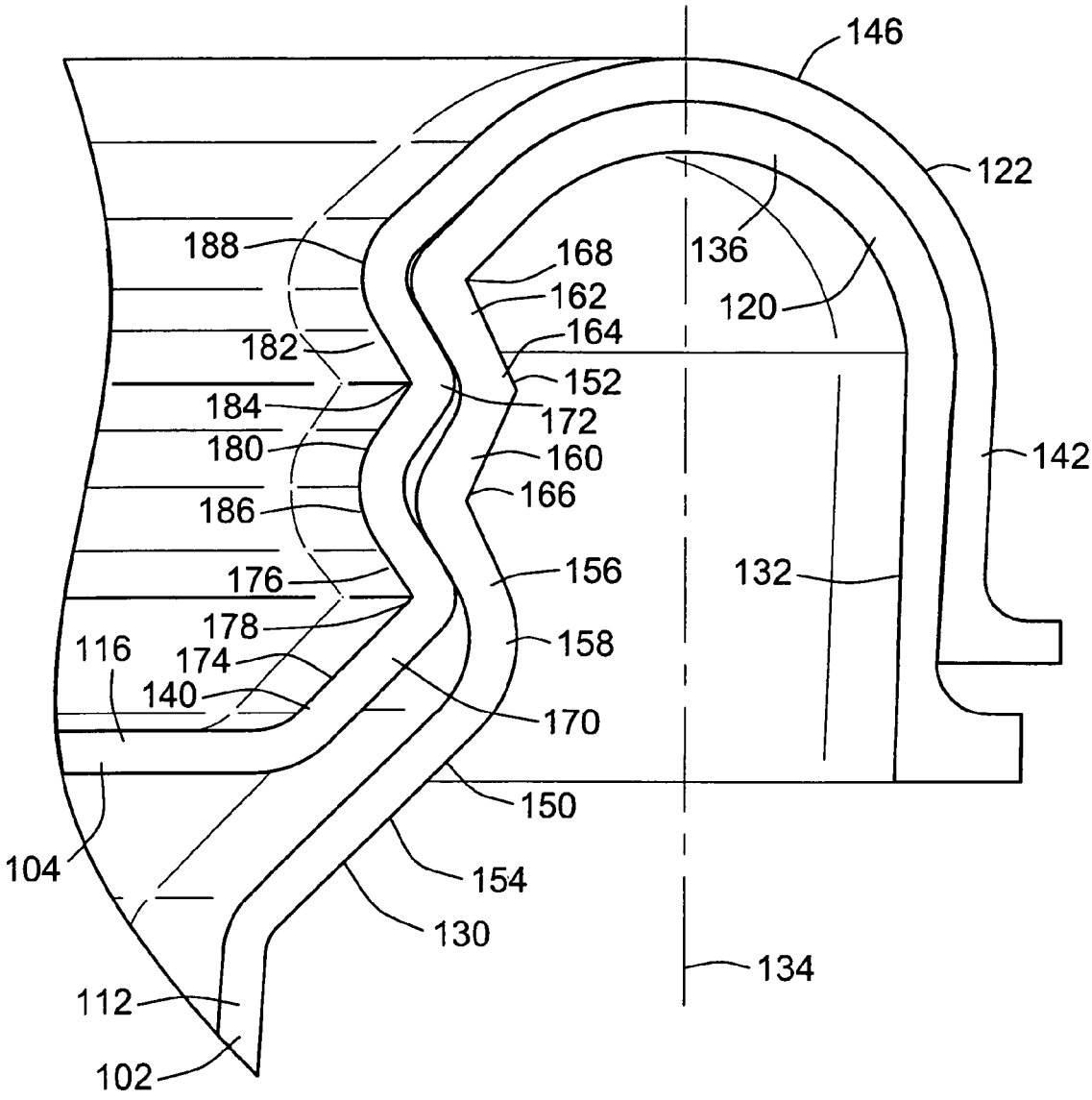
FIG. 5 is a detailed view of the area indicated in FIG. 4 illustrating the first and second closure portions fully engaged.

Referring to FIGS. 4 and 5, the first and second closure portions 120, 122 are formed as a skirt having a U-shaped cross-section that extends about the peripheral edges of the base 102 and cover 104. The first closure portion 120 includes an inner wall 130 that is joined to and extends generally upright from an upright side surface 112. Also included as part of the first closure portion 120 is an outer wall 132 which is spaced-apart from and opposes the inner wall 130. For purposes of reference, the terms "inner" and "outer" and the like refer to reference line 134 of FIGS. 4 and 5 and are not to be construed as additional limitations of the invention. Connecting and extending between the tops of the inner and outer walls 130, 132 is an upward curving intermediate wall 136.

The second closure portion 122 is formed similarly to the first closure portion 120. For example, the second closure portion 122 includes a second inner wall 140 joined to and extending generally upright from the planar surface 116 of the cover and an opposing, spaced-apart second outer wall 142. The use of the terms such as "inner" and "outer" are again used with respect to reference line 134 of FIGS. 4 and 5. For connecting the second inner and second outer walls 140, 142, the second closure portion 122 also includes a second, upward curving intermediate wall 146.

To engage the first and second closure portions 120, 122, the first closure portion is inserted between and gripped by the inner and outer walls 140, 142 of the second closure portion. As will be appreciated, when the first closure portion 120 is inserted into the second closure portion 122, the size differences cause the second closure portion to compressibly grip the first closure portion. The first and second intermediate walls 136, 146 can have a resilient characteristic that provides and transmits the gripping force to the inner and outer walls.

In accordance with an aspect of the invention, to releasably interlock the first and second closure portions 120, 122 together when engaged, at least one cutback portion is formed by an inner wall. In the embodiment illustrated in FIGS. 4 and 5, a first cutback portion 150 and a second cutback portion 152 are formed into the first inner wall 130 of the first closure portion 120. The first and second cutback portions 150, 152 extend along the first closure portion 120 substantially about the periphery of the base 102. The first cutback portion 150 is a shallow, generally V-shaped notch formed by a first, outwardly directed leg 154 that extends from the upright side surface 112 to intersect a first inwardly directed leg 156. The intersection of the first outwardly directed leg 154 and the first inwardly directed leg 156 creates a first outwardly directed trough 158. The second cutback portion 152 is also a shallow, generally V-shaped notch formed by a second outwardly directed leg 160 and a second inwardly directed leg 162 that intersect to create a second outwardly directed trough 164. The first and second cutback portions 150, 152 are arranged vertically adjacent to each other such that the first inwardly directed leg 156 intersects the second outwardly directed leg 160 to create a first inwardly directed ridge 166. Furthermore, the second inwardly directed leg 162 intersects the first intermediate wall 136 to create a second inwardly directed ridge 168.

The second closure portion 122 also includes a third cutback portion 170 and a vertically adjacent fourth cutback portion 172. The third cutback portion 170 is a shallow, generally V-shaped notch formed by a third outwardly directed leg 174 and a third inwardly directed leg 176 that intersect to form a third, outwardly directed trough 178. The fourth cutback portion 172 is also a shallow, generally V-shaped notch formed by a fourth outwardly directed leg 180 and a fourth inwardly directed leg 182 that intersect to form a fourth outwardly directed trough 184. The third and fourth cutback portions 170, 172 are vertically arranged such that the third outwardly directed leg 174 is connected to the planar surface 116. Furthermore, the third inwardly directed leg 176 and the fourth outwardly directed leg 180 intersect to create a third inwardly directed ridge 186. Additionally, the fourth inwardly directed leg 178 intersects the second intermediate wall 146 to form a fourth inwardly directed ridge 188. The vertical distance between the third and fourth cutback portions 170, 172 can correspond to the vertical distance between the first and second cutback portions 150, 152. It will be appreciated that the third and fourth cutback portions 170, 172 also extend substantially about the periphery of the cover 104.

The cutback portions can have any suitable depth depending upon the overall dimensions of the base and cover. In an embodiment, the generally V-shaped notches formed by the cutback portions can have a depth of about 0.030 inches.

When the first and second closure portions 120, 122 are fully engaged, as illustrated in FIG. 5, the first cutback portion 150 aligns with and abuts against the third cutback portion 170 and the second cutback portion 152 aligns with and abuts against the fourth cutback portion 172. It will be appreciated that aligning and adjoining the cutback portions in the foregoing manner interlocks the closure portions and resists detachment of the cover from the base. To enable the first and second closure portions 120 and 122 to engage, the resilient characteristic of the first and second intermediate walls 136, 146 allows the first inner and outer walls 130, 132 to deflect towards each other and the second inner and outer walls 140, 142 to deflect apart from each other. Hence, as the first closure portion 120 is inserted into the second closure portion 122, the inner and outer walls displace to slide over each other. To facilitate sliding insertion, in the illustrated embodiment, both the outer walls 132, 142 can be made as vertically straight, flat structures. Once the cutback portions align, the first and second inner walls 130, 140 resiliently flex against each other to interlock the cutback portions.

An advantage of having two vertically adjacent cutback portions 150, 152, 170, 172 on each of the first and second inner walls 130, 140 is that the engagement between the first and second closure portions 120, 122 is strengthened. For example, it will be appreciated from FIG. 5 that to remove the cover 104 from the base 102, a sufficient pulling force must be applied to cause the third and fourth troughs 178, 184 to slide over the first and second ridges 166, 168. Hence, forming the first and second closure portions 120, 122 each with multiple cutback portions 150, 152, 170, 172 increases the pulling force that must be applied to detach the cover 104 from the base 102. The required force is significant enough to prevent unintentional detachment but is not so excessive so as to make intentional detachment difficult.

Another advantage of having two cutback portions 150, 152, 170, 172 on each of the inner walls 130, 140 is that a double sealing effect is provided. For example, referring to FIG. 5, when the first and second closure portions are fully engaged, a first seal is created by the first and third cutback portions 150, 170 abutting and the inwardly directed legs 156, 176 contacting each other. A second seal is created by the second and fourth cutback portions 152, 172 abutting and the inwardly directed legs 162, 182 contacting each other. The two contact locations facilitate the double sealing effect that helps preserve food items stored in the container and prevents leakage or spillage from the container.

Another advantage of having intermediate walls 136, 146 and outer walls 132, 142 as shown in FIG. 5 is that they may provide a either a continuous or a discontinuous contact surface facilitating a circuitous path to help prevent the contents from leaking.

Figure 6:
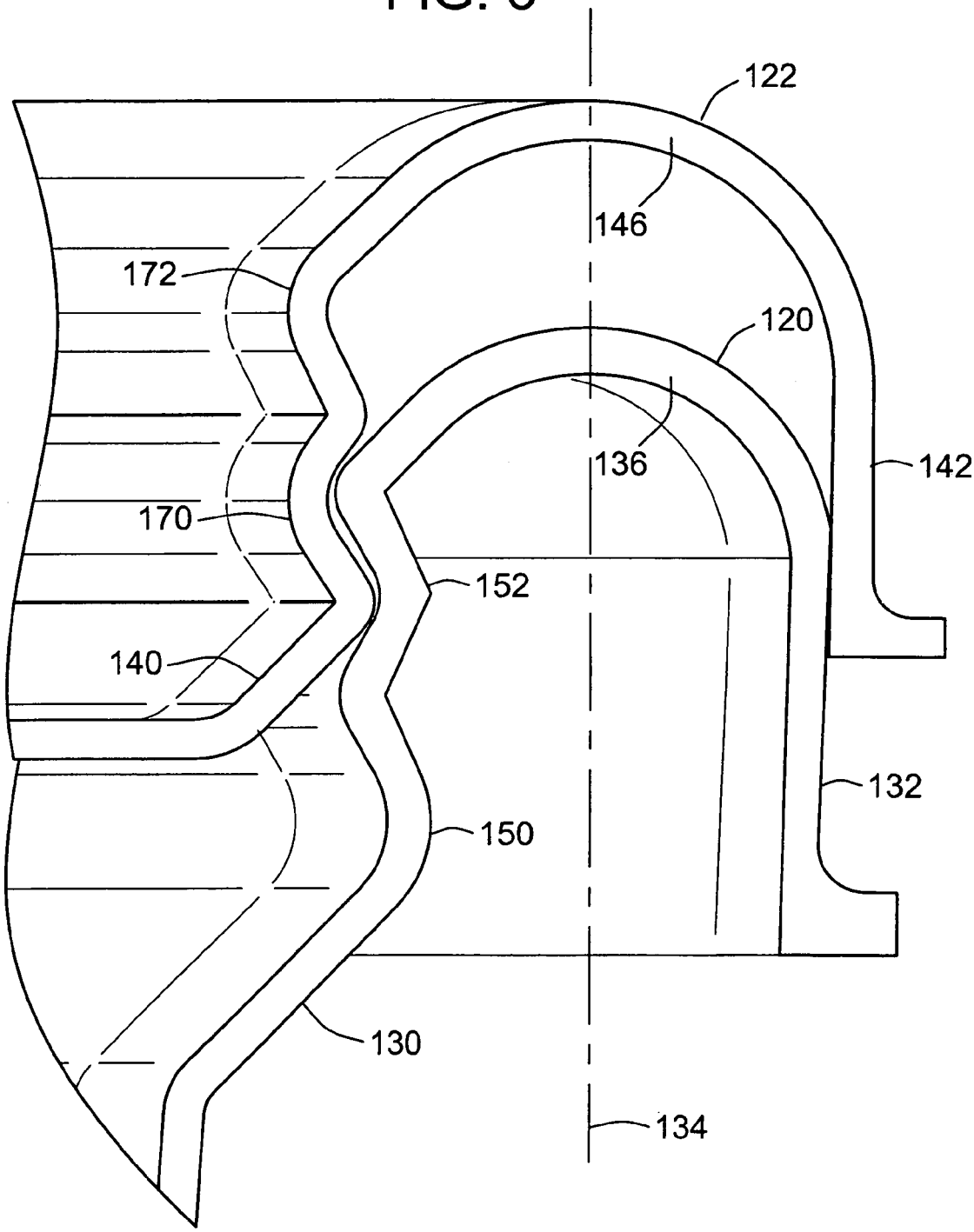
FIG. 6 is a detailed view of the area indicated in FIG. 4 illustrating the first and second closure portions engaged in an intermediate position.

Another advantage of having two vertically adjacent cutback portions 150, 152, 170, 172 on each of the first and second inner walls 130, 140 is that the cutback portions allow for an intermediate engagement position. Referring to FIG. 6, for example, the first closure portion 120 can be inserted into the second closure portion 122 such that the second cutback portion 152 engages with the third cutback portion 170 while the first and fourth cutback portions 150, 172 remain unengaged. By only engaging two of the cutback portions, the seal is less strong and can be more easily broken. This is useful when microwaving food items in the container 100 because the closure portions 120, 122 can more easily disengage to vent steam, preventing the container from becoming pressurized.

Figure 7:
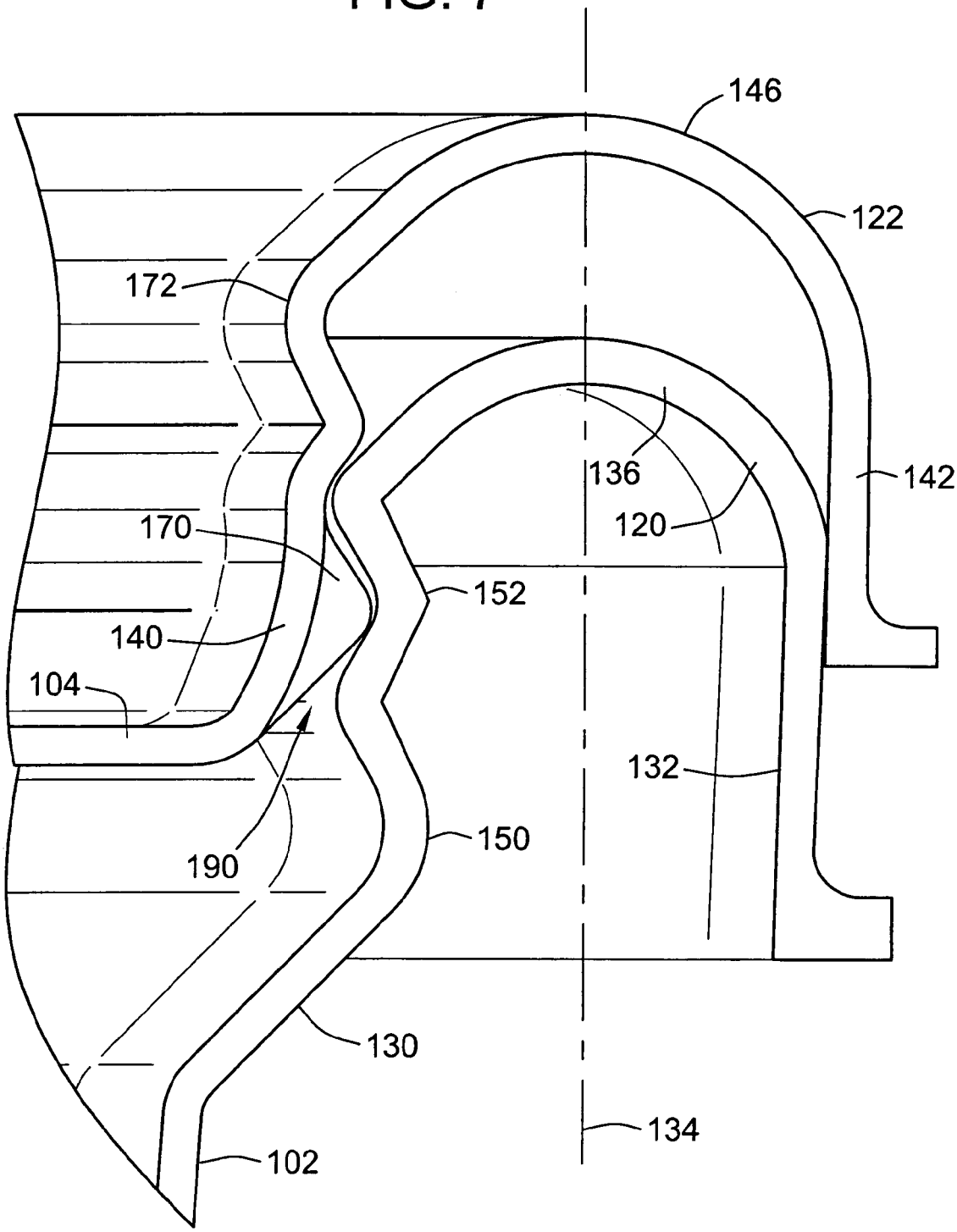
FIG. 7 is a detailed view of the area indicated in FIG. 4 illustrating an embodiment of the first and second closure portions having discontinuities and engaged in the intermediate position.
Figure 8:
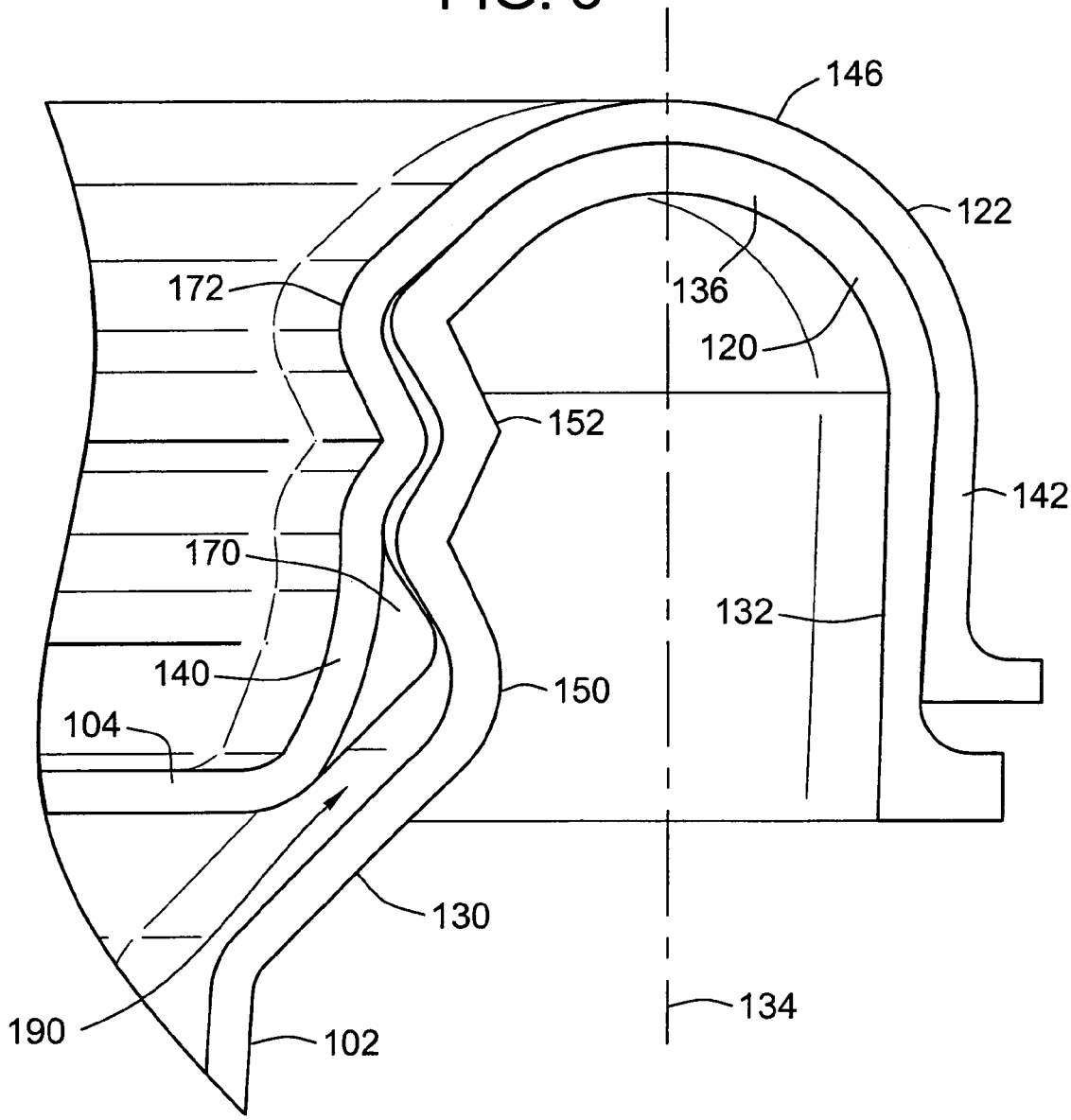
FIG. 8 is a detailed view of the area indicated in FIG. 4 illustrating an embodiment of the first and second closure portions having discontinuities and fully engaged together.

To further facilitate microwaving food items, in another feature of the invention, the first and second closure portions 120, 122 can be provided with discontinuities 190 formed therein. Better illustrated in FIGS. 7 and 8, a discontinuity 190 is formed into the third cutback portion 170 of the cover 104 while the vertically adjacent fourth cutback portion 172 remains intact. Hence, when the first and second closure portions 120, 122 are engaged in the intermediate position, as illustrated in FIG. 7, the discontinuity 190 provides an opened channel via which steam from the cavity 114 can escape past the seal formed by the engaged second and third cutback portions 152, 170. However, when the first and second closure portions 120, 122 are fully engaged, as illustrated in FIG. 8, the second cutback portion 152 and the fourth cutback portion 172 abut each other to provide a continuous seal between the base 102 and cover 104.

In various embodiments, a plurality of discontinuities can be formed into the second closure portion and spaced about the peripheral edge of the cover. Additionally, it will be appreciated that discontinuities can be formed into other cutback portions instead of or in addition to the discontinuities formed into the third cutback portions.

Yet another advantage of having two vertically adjacent cutback portions 150, 152, 170, 172 is that the cutback portions can provide a tactile or audible indication that the first and second closure portions 120, 122 are engaged. Referring to FIGS. 4, 5, and 6, it will be appreciated that as the third cutback portion 170 slides to engage the second cutback portion 152, a first tactile and/or audible indication is produced indicating to a user that the base 102 and cover 104 are intermediately engaged. Then, as the third cutback portion 170 slides to engage the first cutback portion 150 and the fourth cutback portion 172 slides to engage the second cutback portion 152, a second tactile and/or audible indication is produced indicating to the user that the base 102 and cover 104 are fully engaged.

Figure 9:
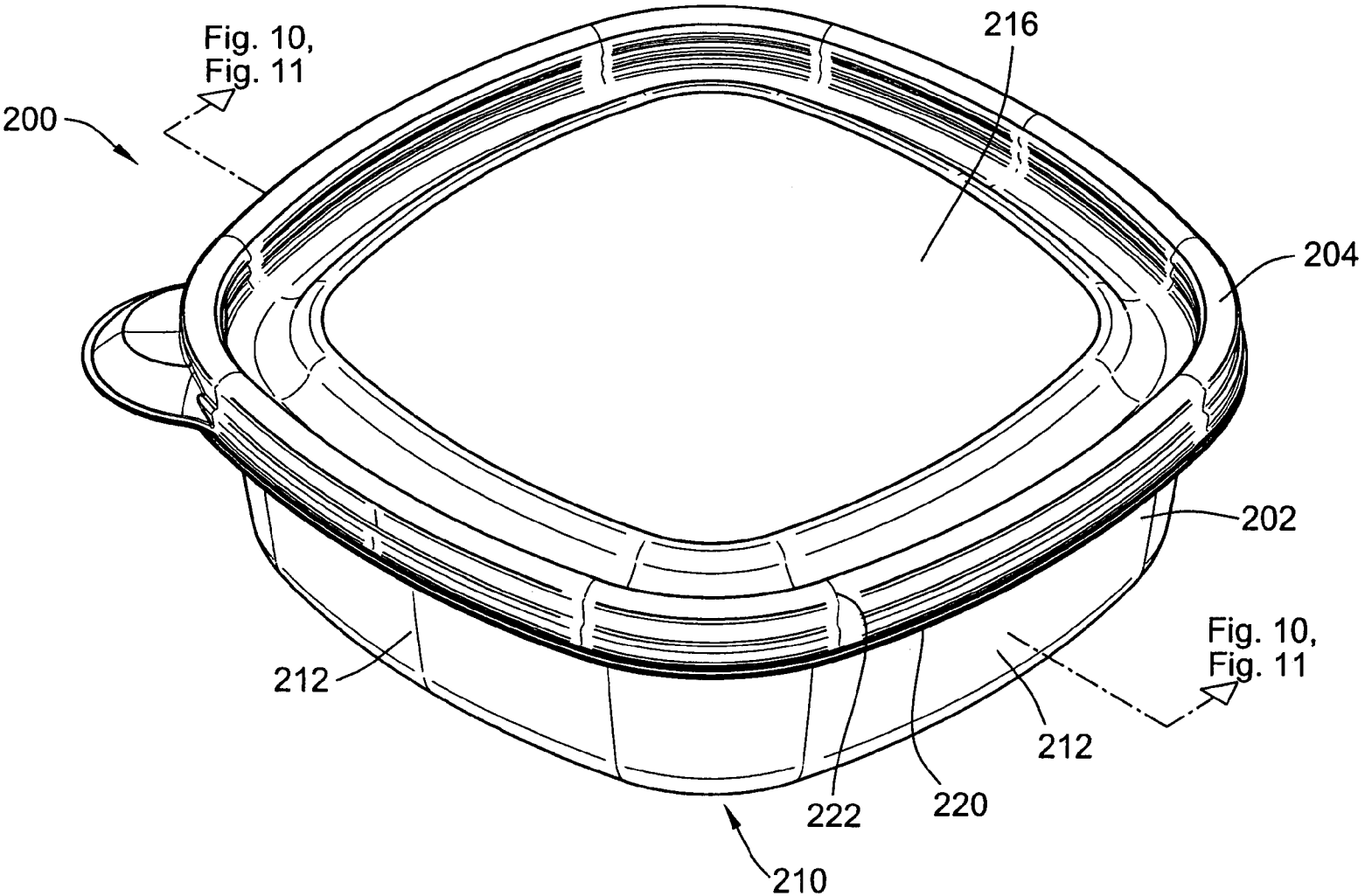
FIG. 9 is a top perspective view of another embodiment of a container having a base and an attached cover designed in accordance with the teachings of the invention.
Figure 10:
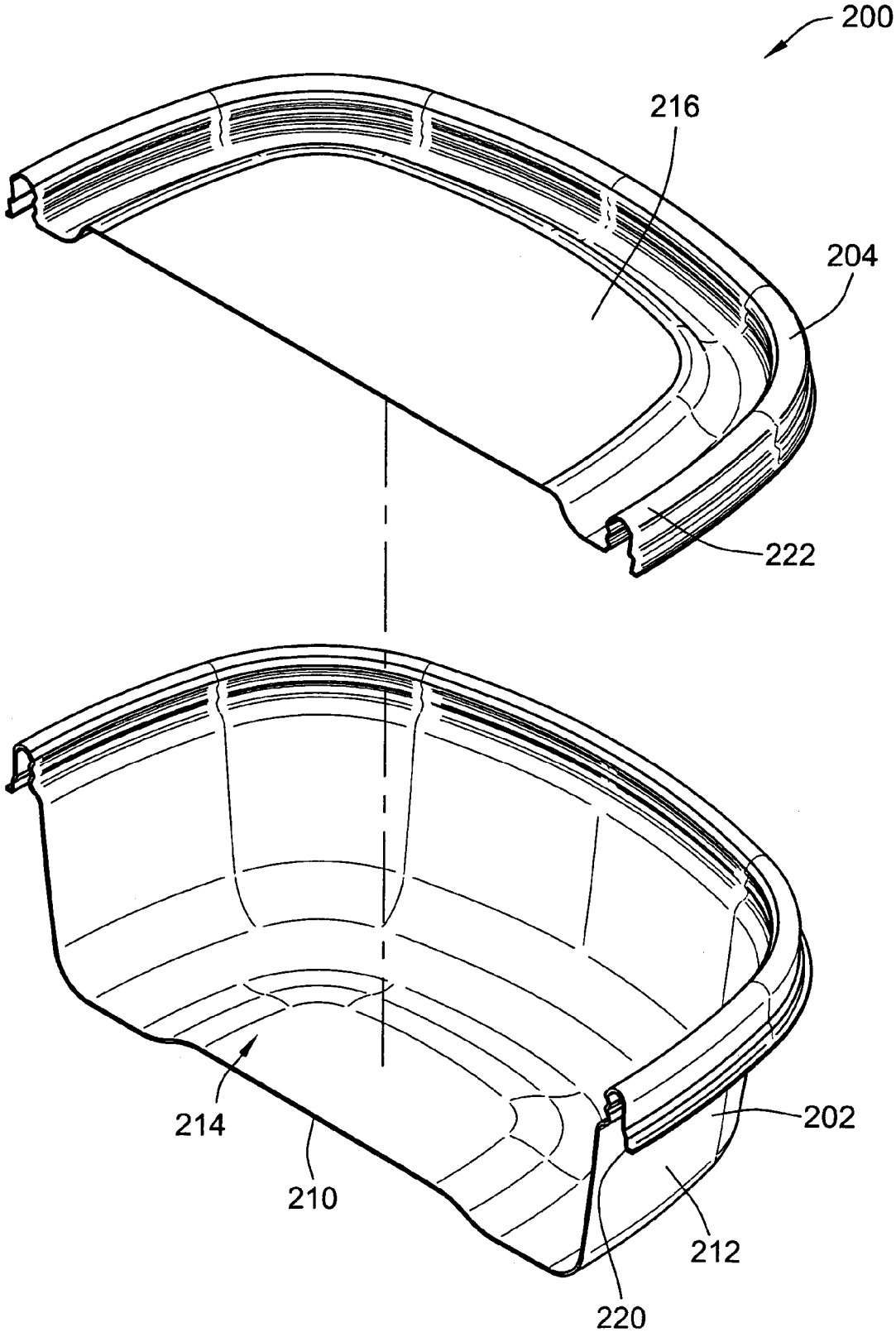
FIG. 10 is a perspective, cross-sectional view taken along line 10-10 of FIG. 9 illustrating the cavity defined by the base and the detached cover.
Figure 11:
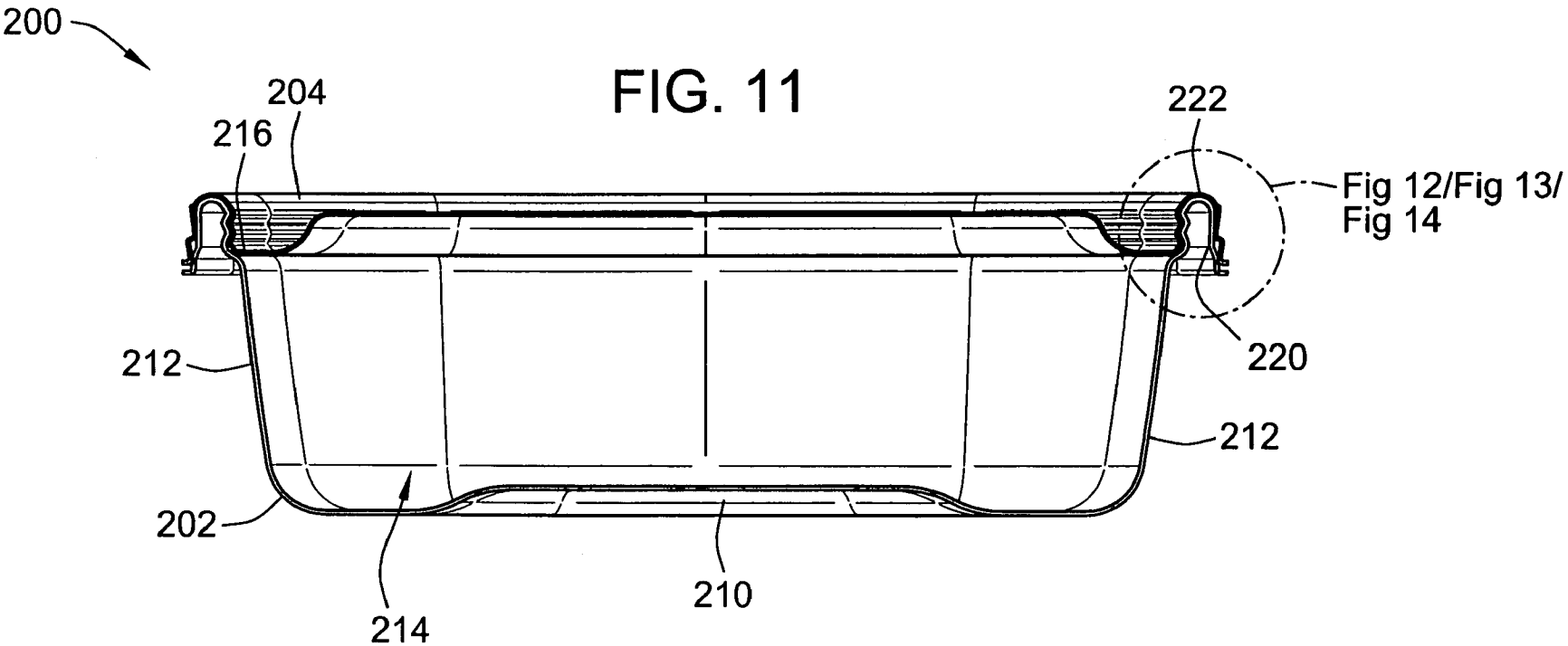
FIG. 11 is a side elevational view of the cross-section taken along line 10-10 of FIG. 9 illustrating the base and cover attached by engagable closure portions.

Referring to FIGS. 9, 10, and 11, there is illustrated another embodiment of a container 200 having a base 202 and a detachable cover 204. The base 202 includes a bottom surface 210 and four upright side surfaces 212 which define a cavity 214 that functions as a storage area into which food items can be placed. The cover 204 is a generally planar tray having a horizontal surface 216 that can engage the base 202 to enclose the cavity 214. To releasably attach the base 202 and cover 204, the base and cover each includes a respective first and second closure portion 220, 222. The first closure portion 220 is formed at and extends about the peripheral edge of the base 202 defined by the upper edges of the four side surfaces 212. The second closure portion 222 is similarly formed at and extends about the peripheral edge of the cover 204.

Figure 12:
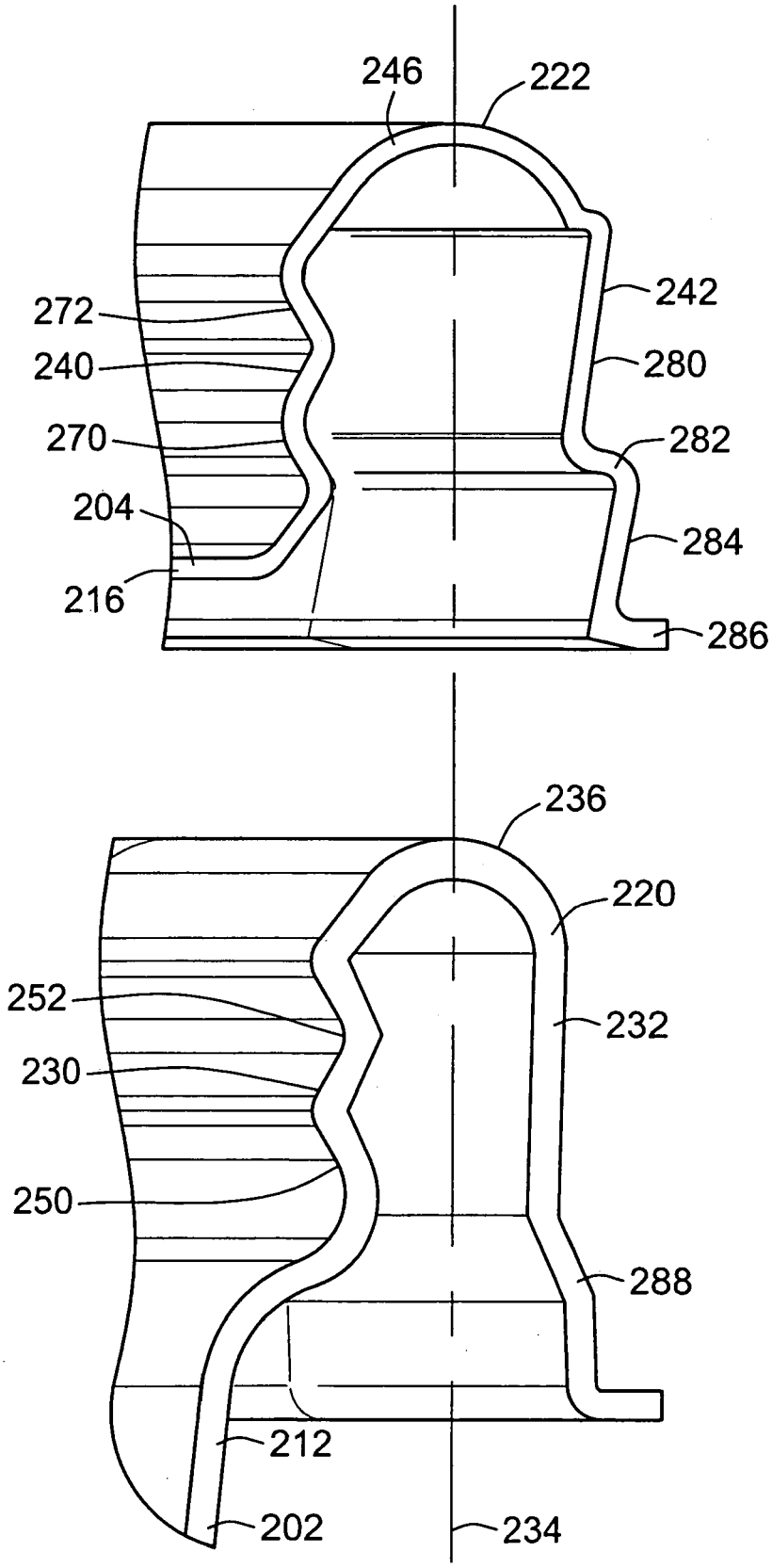
FIG. 12 is a detailed view of the area indicated in FIG. 11 illustrating another embodiment of the first and second closure portions disengaged and separated from each other.
Figure 13:
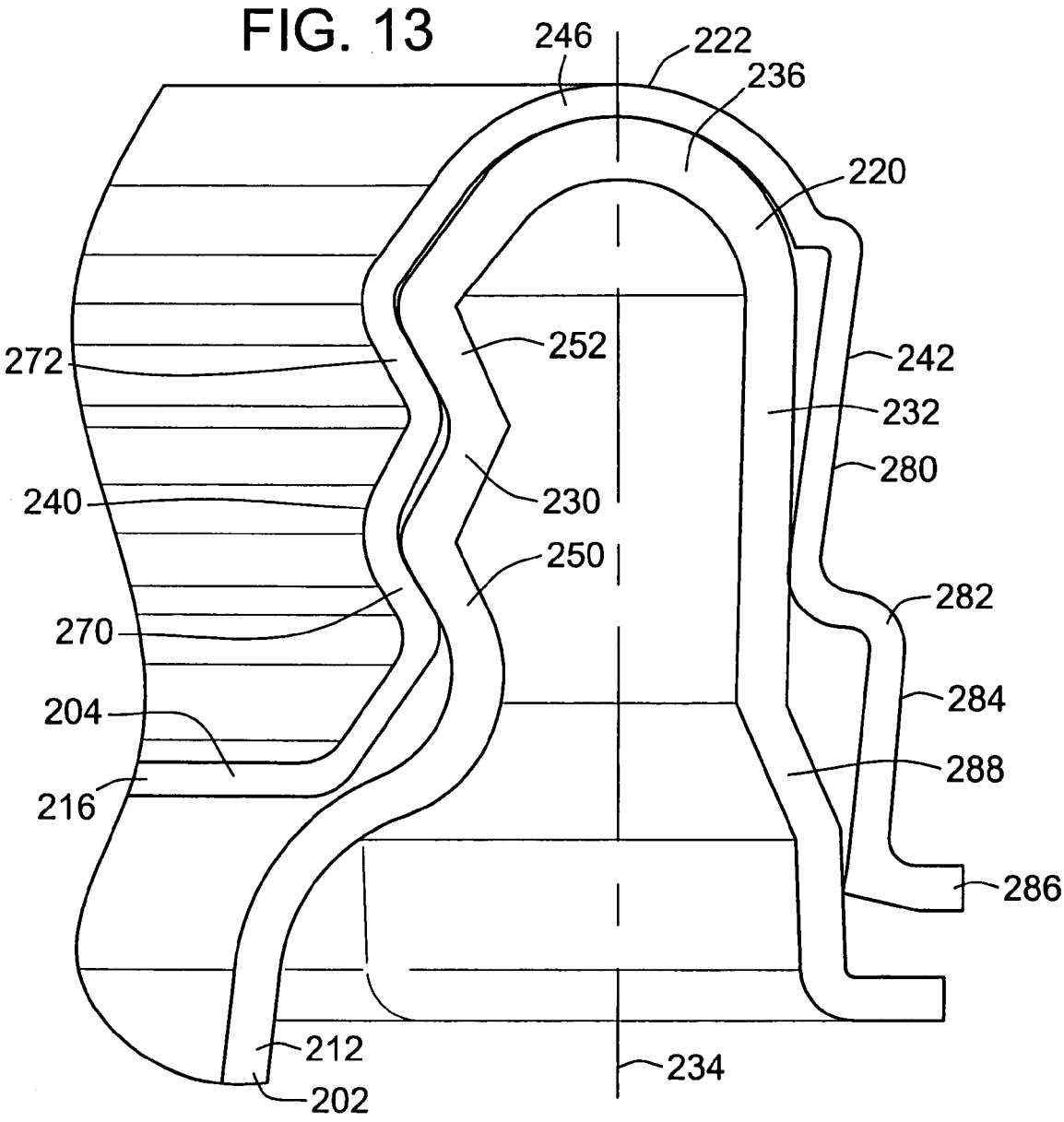
FIG. 13 is a detailed view of the area indicated in FIG. 11 illustrating the first and second closure portions fully engaged.

Referring to FIGS. 12 and 13, the first and second closure portions 220, 222 are each formed as a skirt having a U-shaped cross-section that extends about the peripheral edges of the base 202 and cover 204. The first closure portion 220 includes an inner wall 230 that is joined to and extends generally upright from an upright side surface 212. Also included as part of the first closure portion 220 is an outer wall 232 which is spaced-apart from and opposes the inner wall 230. Located between and interconnecting the inner and outer walls 230, 232 is an upwardly curved intermediate wall 236. For purposes of reference, the terms "inner" and "outer" and the like refer to reference line 234 of FIGS. 12 and 13 and are not to be construed as an additional limitation of the invention. The second closure portion 222 is also formed as a U-shaped skirt with an inner wall 240 extending from horizontal surface 216 of the cover 202 and a spaced-apart outer wall 242 that is interconnected to the inner wall by an upwardly curved intermediate wall 246.

As will be appreciated, when the first closure portion 220 is inserted into the second closure portion 222, the size difference provides a compressive gripping force engaging the first and second closure portions.

To enable the first and second closure portions 220, 222 to releasably interlock when engaged, the inner walls 230, 240 of both closure portions include one or more cutback portions. For example, the inner wall 230 of the first closure portion 220 includes a first cutback portion 250 and a vertically adjacent second cutback portion 252. Likewise, the inner wall 240 of the second closure portion 222 includes a third cutback portion 270 and a vertically adjacent fourth cutback portion 272. The cutback portions 250, 252, 270, 272 can be formed and engage in the above described manner. Hence, the double cutback portions 250, 252, 270, 272 provide the double sealing effect and the double tactile and/or audible indication of engagement. For example, referring to FIG. 13, when the first and second closure portions are fully engaged, a first seal is created by contact between the inwardly directed legs located above the first and third cutback portions 250, 270. The second seal is created by contact between the inwardly directed legs located above the cutback portions 252, 272, contacting each other. The two contact locations facilitate the double sealing effect that helps preserve food items stored in the container and prevents leakage or spillage from the container.

Another advantage of having intermediate walls 236, 246 and outer walls 232, 242 as shown in FIG. 13 is that they may provide a either a continuous or a discontinuous contact surface facilitating a circuitous path to help prevent the contents from leaking.

Figure 14:
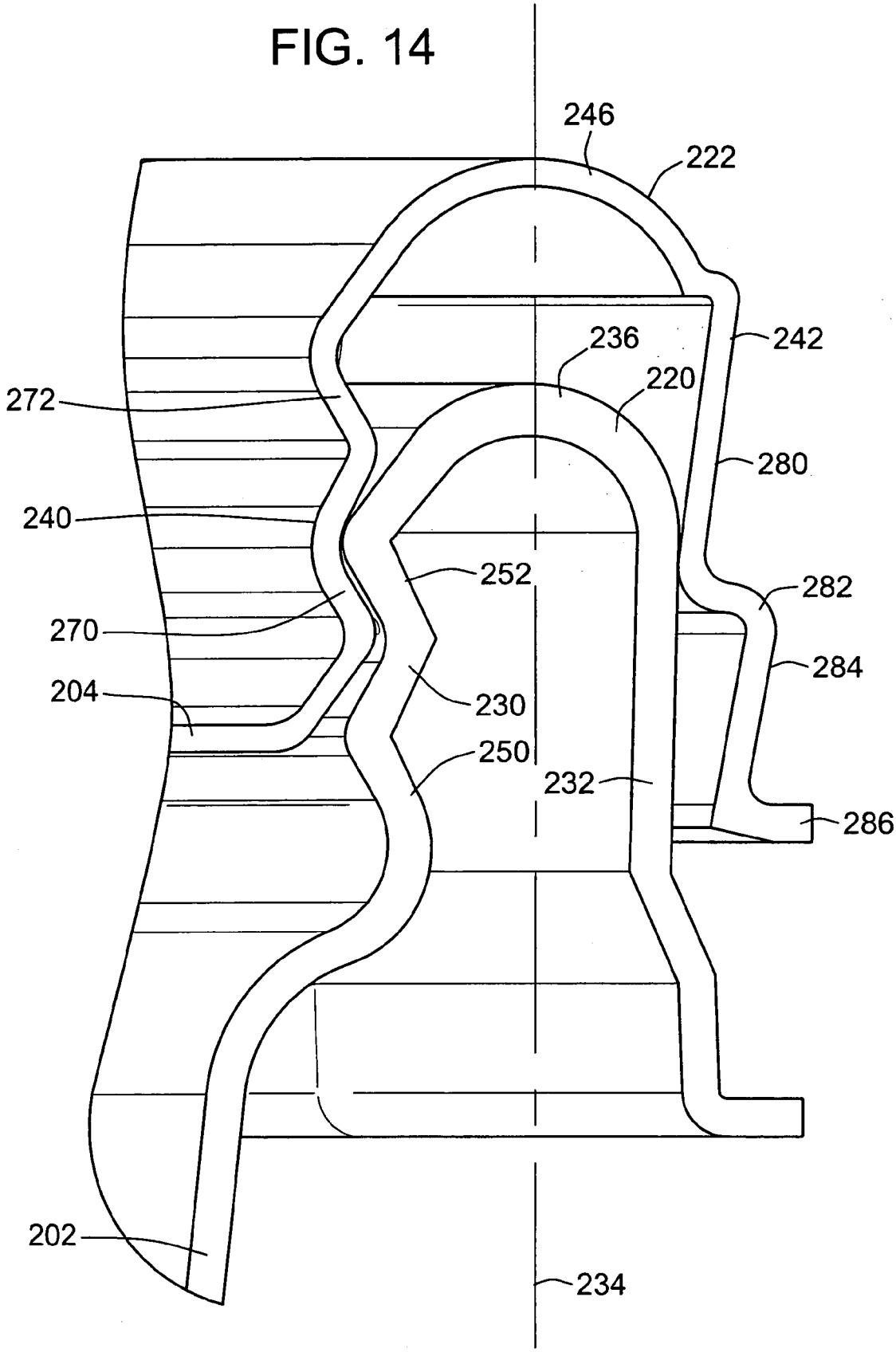
FIG. 14 is a detailed view of the area indicated in FIG. 4 illustrating the first and second closure portions engaged in an intermediate position.

Furthermore, the cutback portions 250, 252, 270, 272 enable the base 202 and cover 204 to be attached in either a fully engaged position as illustrated in FIG. 13 or an intermediate position as illustrated in FIG. 14.

To further facilitate the gripping force between the engaged closure portions 220, 222, in the embodiment illustrated in FIGS. 12 and 13, the outer wall 242 of the second closure portion is formed to partially angle inwards toward the inner wall 240. For example, the outer wall 242 includes a first angled leg 280 that extends downward from the intermediate wall 246 and partially toward the inner wall 240 and reference line 234. The outer wall also includes a first step 282 that protrudes outward and has a second angled leg 284 that extend partially toward the inner wall 240 and reference line 234. Directed outward from the bottom edge of the second angled leg 284 is a outwardly directed flange 286. The outer wall 232 of the first closure portion 220 also includes a second outward protruding step 288 that corresponds in location to the first step 282. Hence, in FIG. 13, when the first and second closure portions 220, 222 are fully engaged, the first angled leg 280 presses against the first outer wall 232 and the first step 282 slides about the second step 288 so that the second angled leg 284 presses against the second step. Moreover, in FIG. 14, when the first and second closure portions 220, 222 are intermediately engaged, the outward flange 286 abuts atop of the second step 288.

Figure 15:
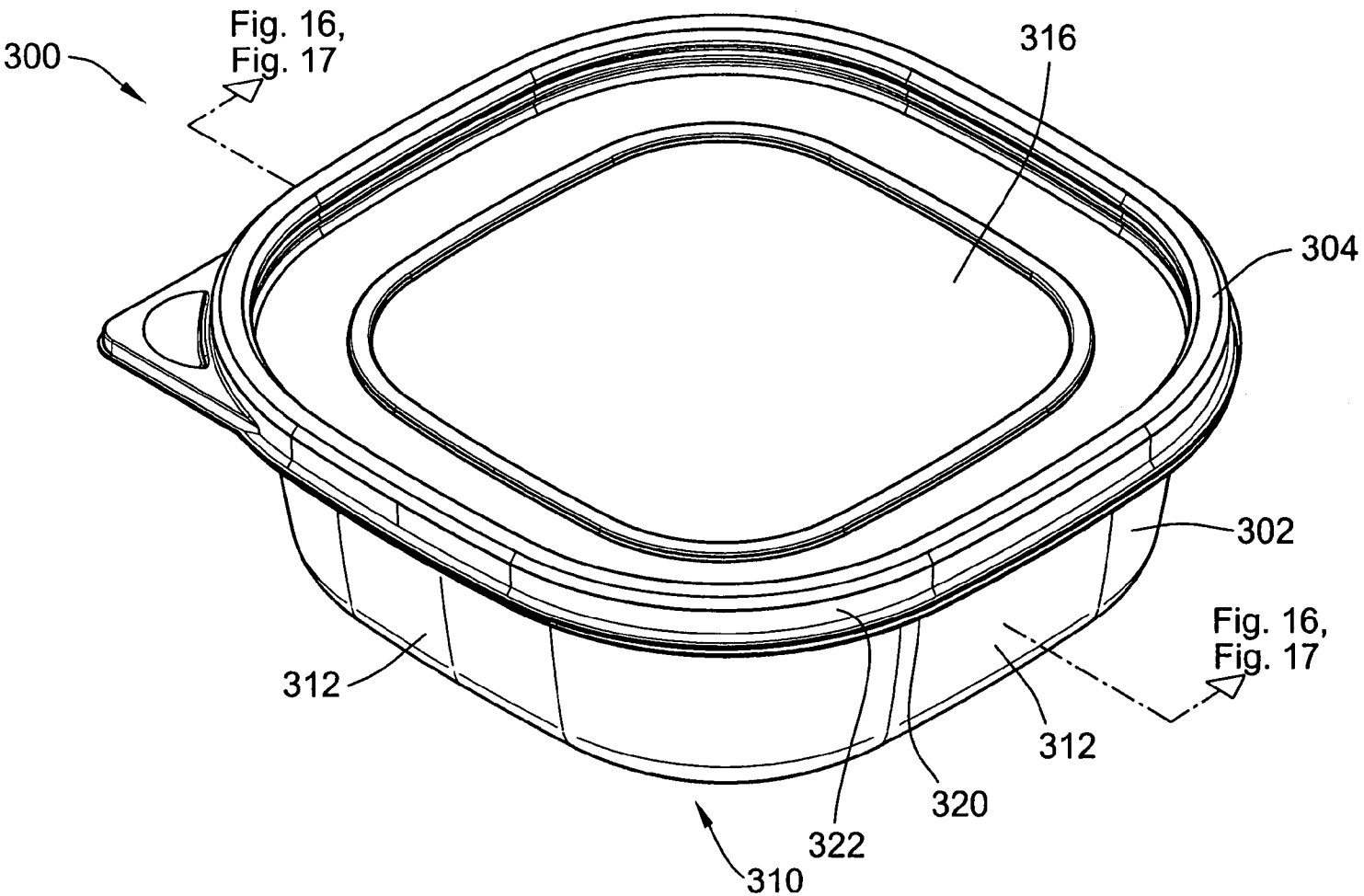
FIG. 15 is a top perspective view of another embodiment of a container having a base and an attached cover designed in accordance with the teachings of the invention.
Figure 16:
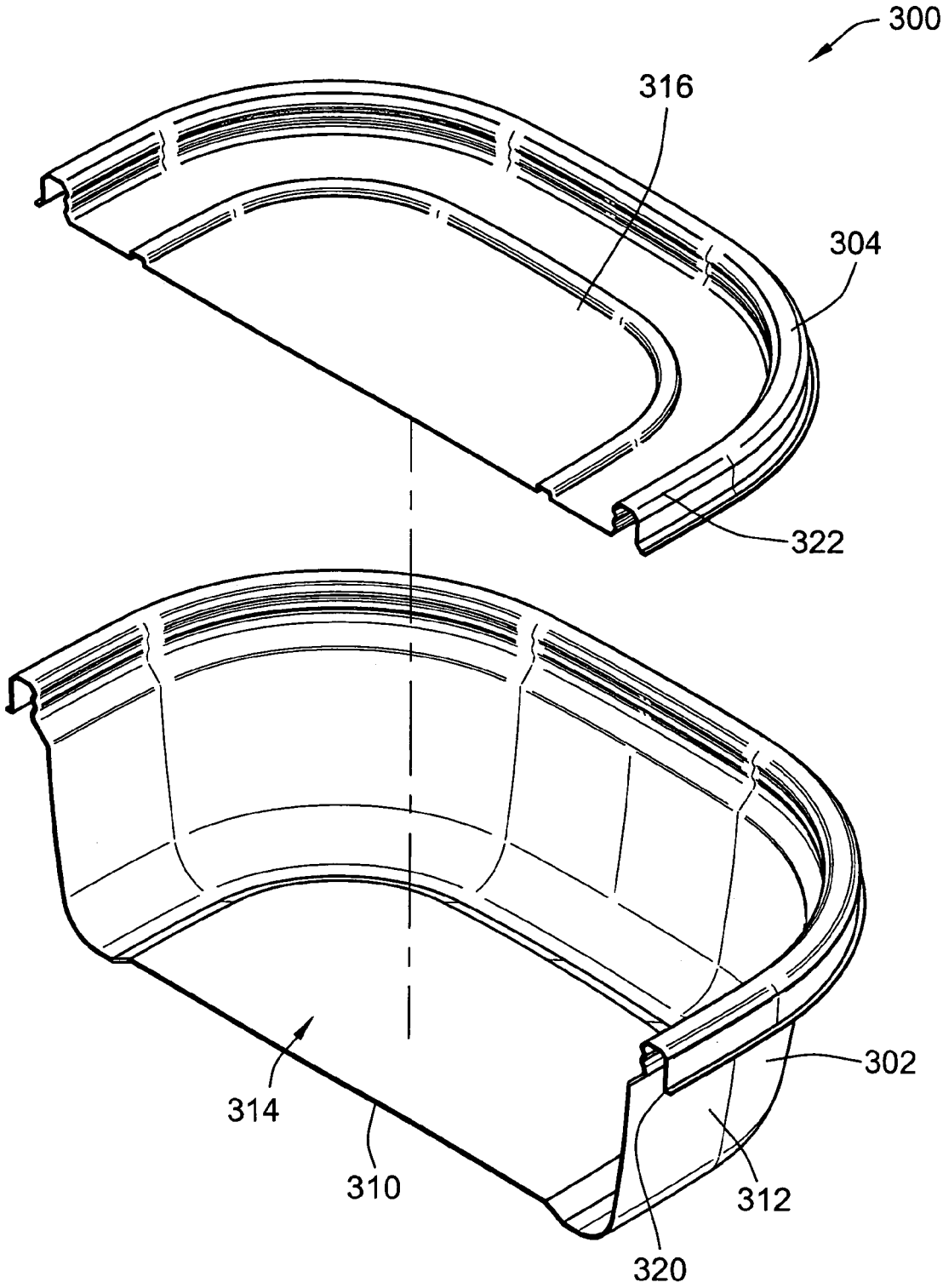
FIG. 16 is a perspective, cross-sectional view taken along line 16-16 of FIG. 15 illustrating the cavity defined by the base and the detached cover.
Figure 17:
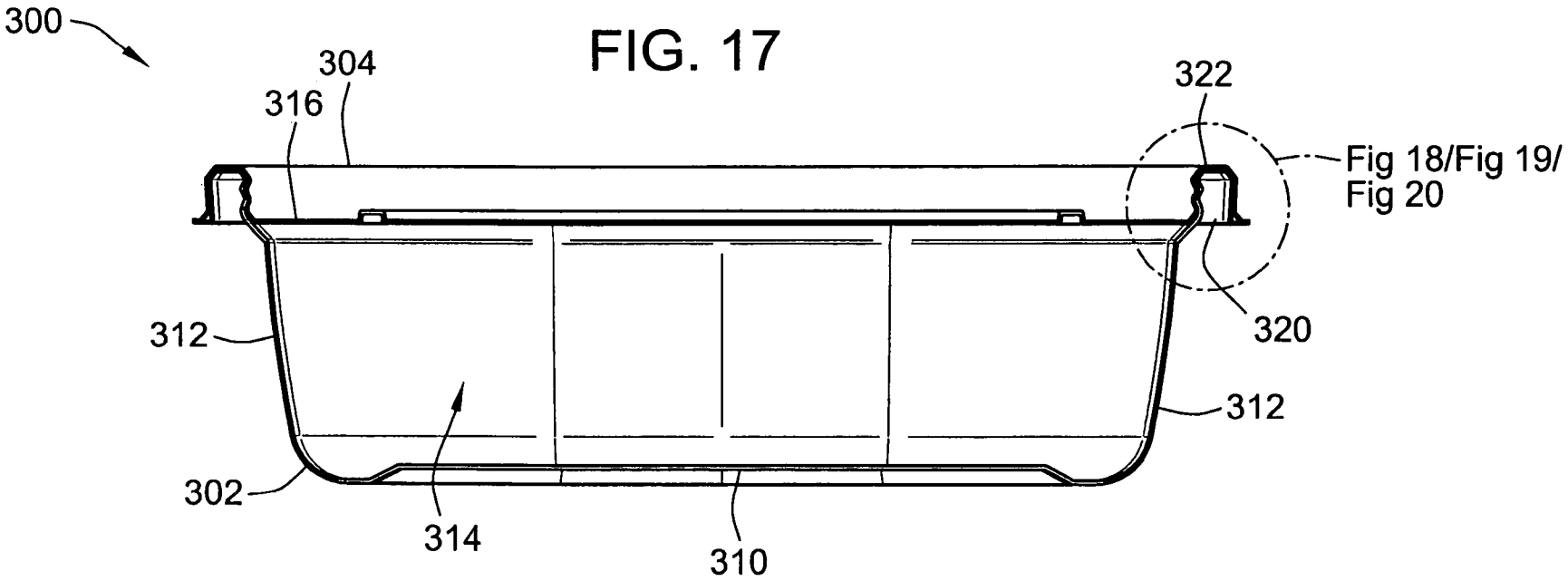
FIG. 17 is a side elevational view of the cross-section taken along line 16-16 of FIG. 15 illustrating the base and cover attached by engagable closure portions.

Referring to FIGS. 15, 16, and 17, there is illustrated another embodiment of a container 300 having a base 302 and a detachable cover 304. The base 302 includes a bottom surface 310 and four upright side surfaces 312 which define a cavity 314 that functions as a storage area into which food items can be placed. The cover 304 is a generally planar tray having a horizontal surface 316 that can engage the base 302 to enclose the cavity 314. To releasably attach the base 302 and cover 304, the base and cover each includes a respective first and second closure portion 320, 322. The first closure portion 320 is formed at and extends about the peripheral edge of the base 302 defined by the upper edges of the four side surfaces 312. The second closure portion 322 is similarly formed at and extends about the peripheral edge of the cover 304.

Figure 18:
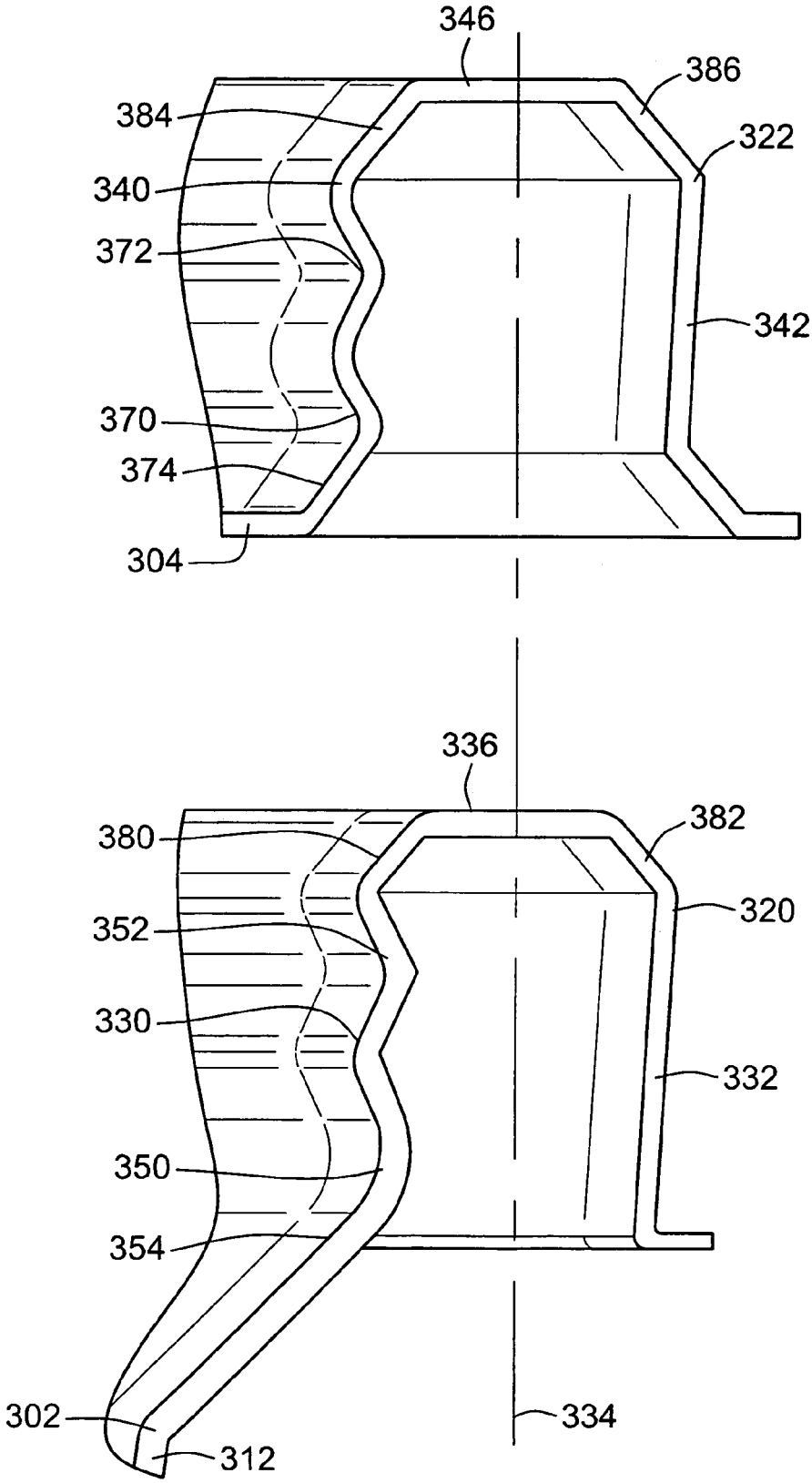
FIG. 18 is a detailed view of the area indicated in FIG. 17 illustrating another embodiment of the first and second closure portions disengaged and separated from each other.
Figure 19:
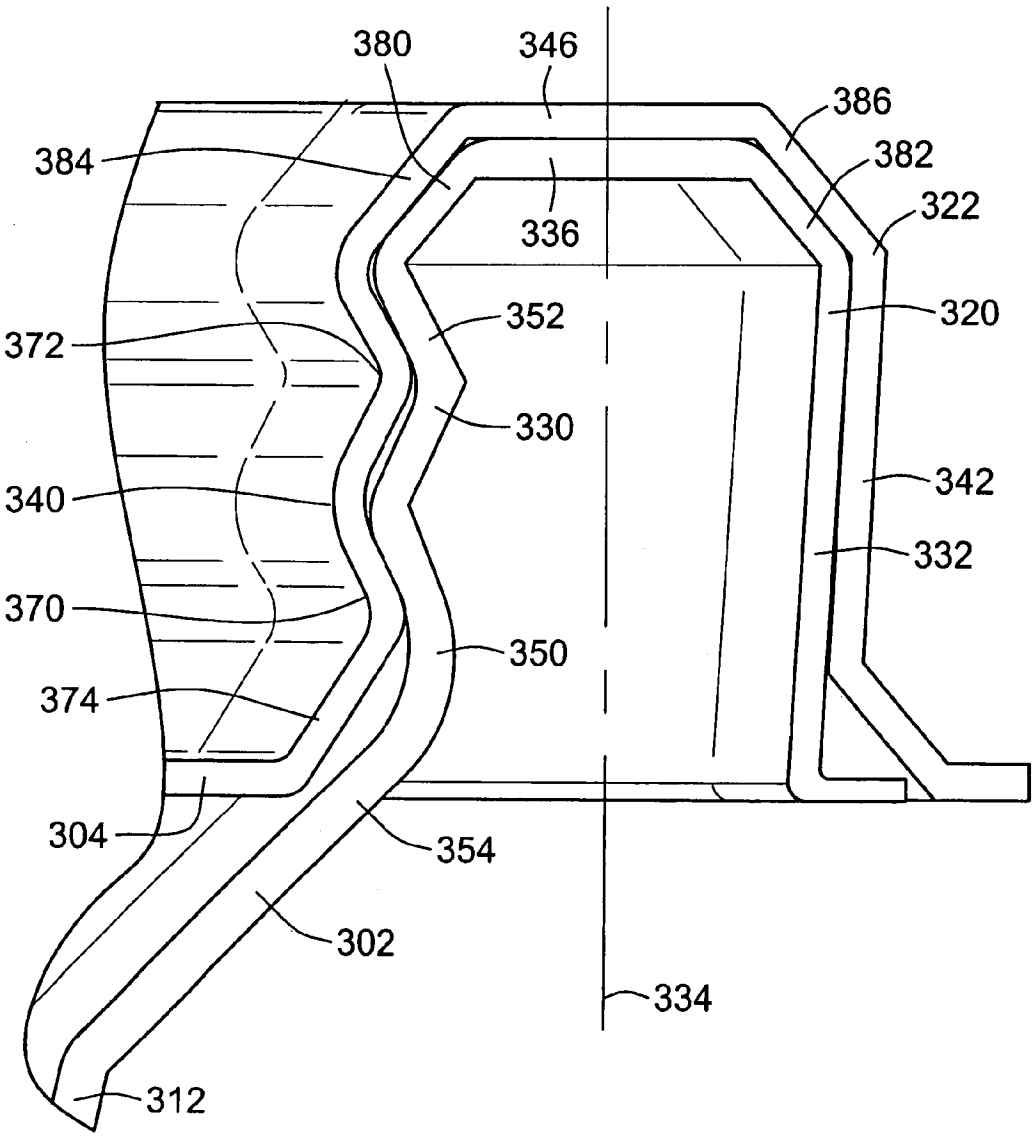
FIG. 19 is a detailed view of the area indicated in FIG. 17 illustrating the first and second closure portions fully engaged.

Referring to FIGS. 18 and 19, the first and second closure portion 320, 322 are both formed as a U-shaped skirt extending about the peripheral edge of the respective base 302 and cover 304. The first closure portion 320 includes an inner wall 330 extending vertically from the upright side surfaces 312 and a spaced-apart outer wall 332. As mentioned above, the terms "inner" and "outer" are made with respect to reference line 334. The inner and outer walls 330, 332 are connected by an intermediate wall 336. Like the first closure portion 320, the second closure portion 322 also includes an inner wall 340 and a spaced-apart outer wall 342 which are interconnected by an intermediate wall 346. To engage the first and second closure portions 320, 322, the first closure portion is inserted between and compressively gripped by the inner and outer walls 340, 342 of the second closure portion.

To enable the first and second closure portions 320, 322 to releasably interlock when engaged, the inner walls 330, 340 of both closure portions include one or more cutback portions. For example, the inner wall 330 of the first closure portion 320 includes a first cutback portion 350 and a vertically adjacent second cutback portion 352. Likewise, the inner wall 340 of the second closure portion 322 includes a third cutback portion 370 and a vertically adjacent fourth cutback portion 372. The cutback portions 350, 352, 370, 372 can be formed and engage in the above described manner. Hence, the double cutback portions 350, 352, 370, 372 provide the double sealing effect and the double tactile and/or audible indication of engagement. For example, referring to FIG. 19, the first seal is created by contact between the inwardly directed legs located above the first and second cutback portions 350, 370. The second seal is likewise created by contact between the inwardly directed legs located above the third and fourth cutback portions 352, 372. The two contact locations facilitate the double sealing effect that helps preserve food items stored in the container and prevents leakage or spillage from the container.

Furthermore, the cutback portions 350, 352, 370, 372 enable the base 302 and cover 304 to be attached in either a fully engaged position as illustrated in FIG. 19 or an intermediate position similar to that illustrated in FIGS. 6 and 14.

In another aspect of the invention, as illustrated in the embodiment of FIGS. 18 and 19, to facilitate stacking of the base 302 and cover 304, the first and second closure portions 320, 322 can include shoulders formed between each of the inner and outer walls and the intermediate walls. For example, the vertically oriented inner wall 330 of the first closure portion 320 is connected to the horizontally oriented intermediate wall 336 by a first shoulder 380 that slants on an approximately 45° angle between the inner and intermediate walls. The vertically oriented outer wall 332 and the intermediate wall 336 are likewise connected by a slanted second shoulder 382. Referring to the second closure portion 322 on the cover 304, the vertically oriented inner and outer walls 330, 332 are also connected to the horizontally oriented intermediate wall 336 respectively by slanted third and fourth shoulders 384, 386.

To operatively engage the shoulders, the first and third inwardly directed legs 354, 374 of the respective first and third cutback portions 350, 370 are slanted on an approximate 45° angle. Additionally, the lower edge of the second outer wall 342 is formed with a foot 388 that slants outward at an approximately 45° angle.

Figure 20:
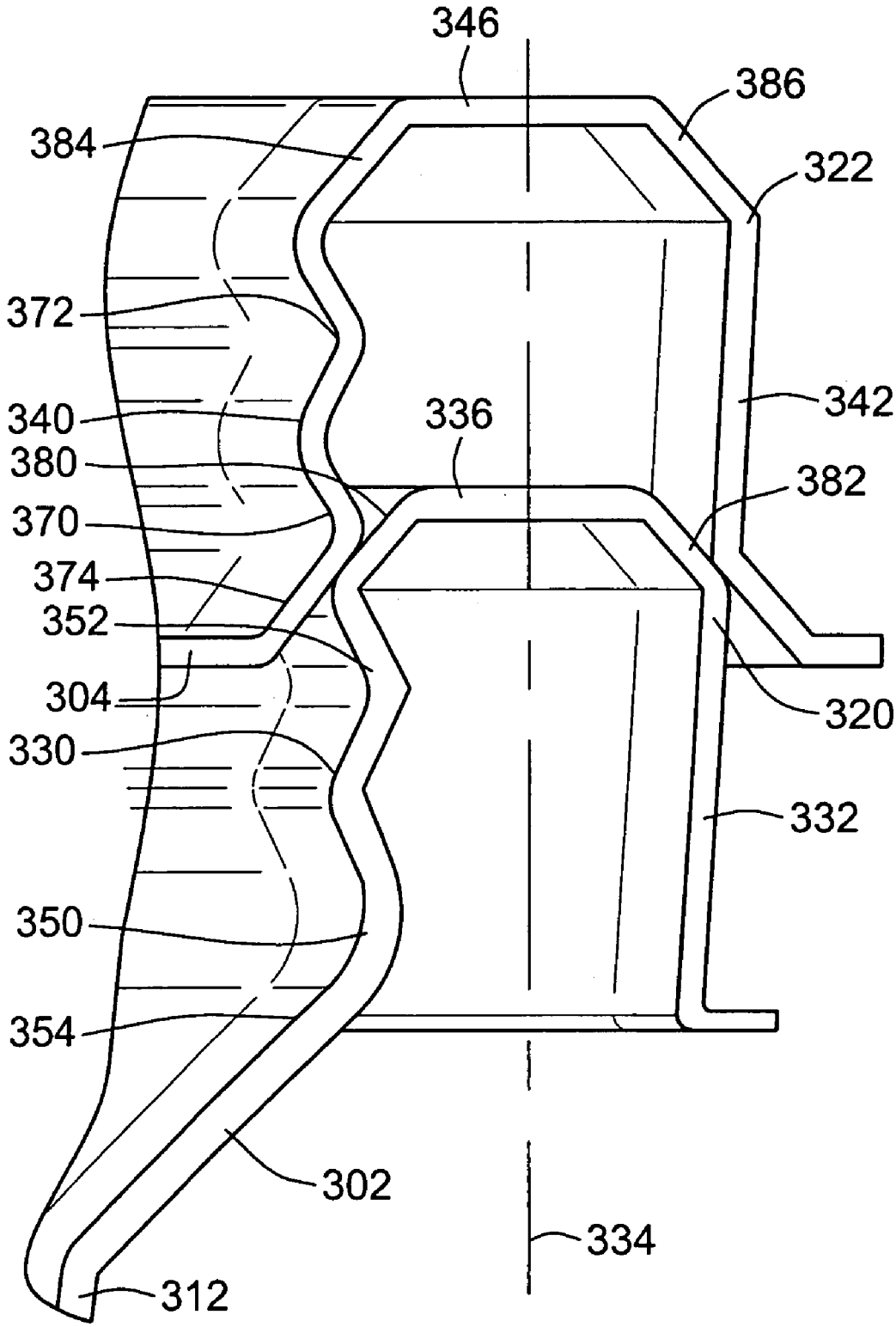
FIG. 20 is a detailed view of the area indicated in FIG. 17 illustrating the first and second closure portions stacked together.

Referring to FIG. 20, the base 302 and the lid 304 are arranged with the stacking shoulder being operatively engaged in a stacked or assembled manner. For example, the second closure portion 322 can be set upon the first closure portion 320 such that that third inwardly directed leg 374 of the third cutback portion 370 contacts the first shoulder portion 380. Additionally, the slanted foot 388 of the second outer wall 342 contacts the second shoulder portion 382. Hence, second closure portion 322 is supported in a stable manner on top of the first closure portion 320 at two distinct areas of contact: (1) the first shoulder 380 and third inwardly directed leg 370 engagement; and (2) the second shoulder 382 and slanted foot 388 engagement. Additionally, it will be appreciated that engaging first and second shoulders 380, 382 with the respective third inwardly directed leg 370 and slanted foot 388 along approximately 45° slanted surfaces provides a nesting effect that counters both horizontal and vertical forces. Hence, when stacked, the base 302 and cover 304 resist being unintentionally knocked apart by lateral forces. Stacking or assembling the base and cover facilitates organized storage of the container with a cupboard. Furthermore, it will be appreciated by those of skill in the art that the shoulder portions also allow for multiple covers to be stacked together and multiple bases to be stacked together.

Figure 21:
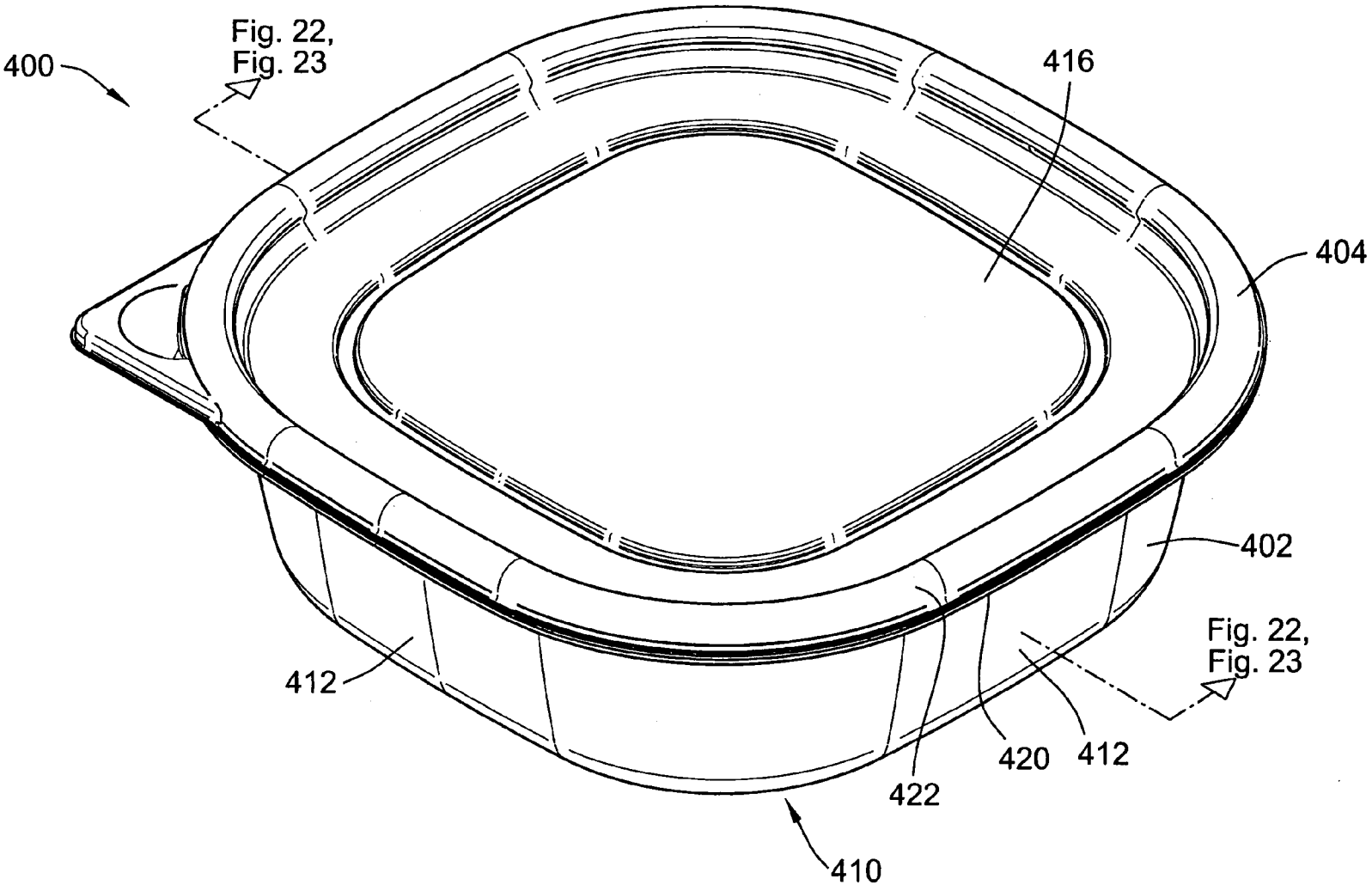
FIG. 21 is a top perspective view of another embodiment of a container having a base and an attached cover designed in accordance with the teachings of the invention.
Figure 22:
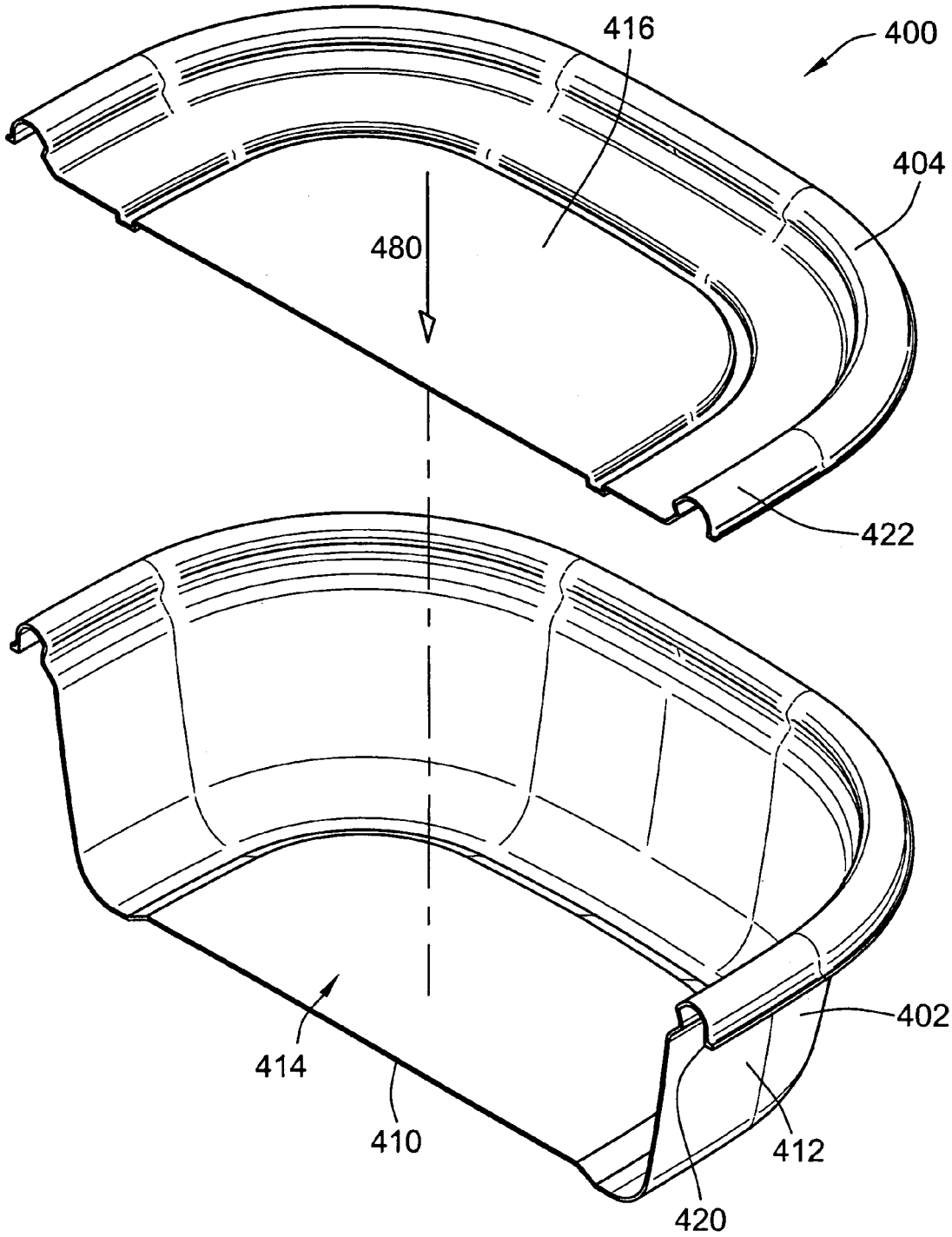
FIG. 22 is a perspective, cross-sectional view taken along line 22-22 of FIG. 21 illustrating the cavity defined by the base and the detached cover.
Figure 23:
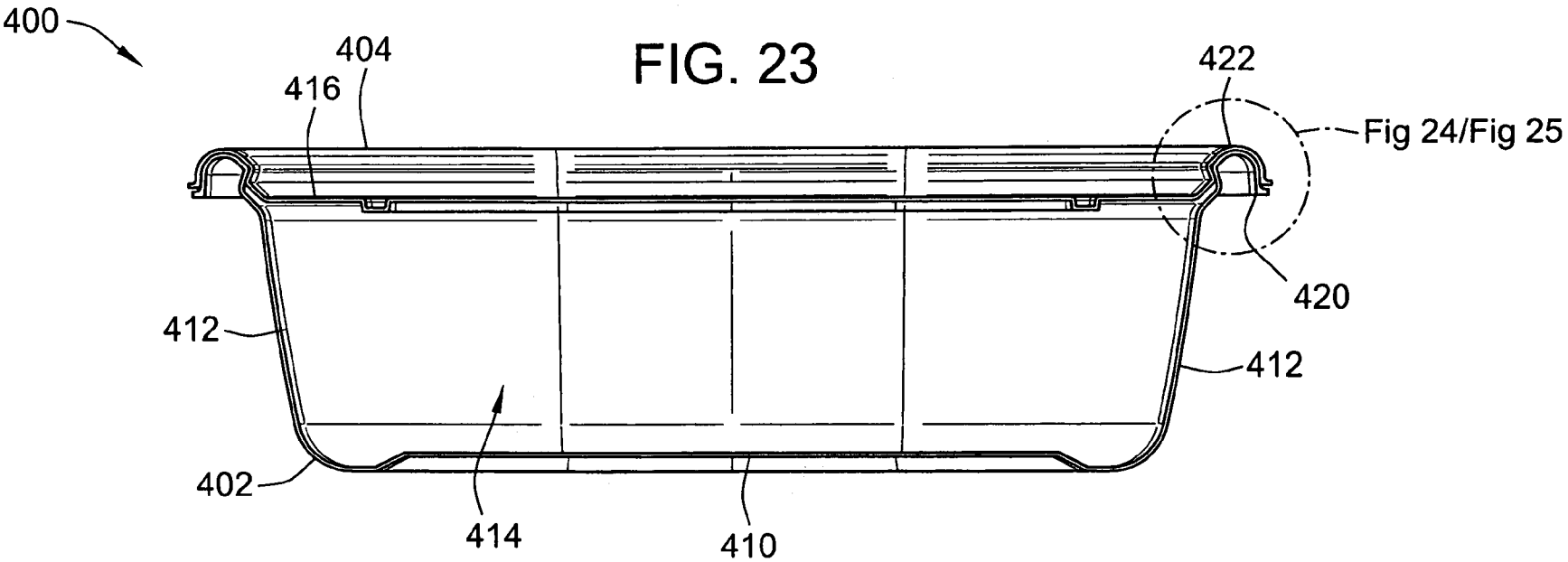
FIG. 23 is a side elevational view of the cross-section taken along line 22-22 of FIG. 21 illustrating the base and cover attached by engagable closure portions.

Referring to FIGS. 21, 22, and 23, there is illustrated another embodiment of a container 400 having a base 402 and a detachable cover 404. The illustrative base 402 includes a horizontal bottom surface 410 and four upright side surfaces 412 that define a cavity 414 into which food items can be placed. The cover 404 is a generally planar tray having a horizontal surface 416 that can engage the base 402 to enclose the cavity 414. To releasably attach the base 402 and cover 404, the base and cover each includes a respective first and second closure portion 420, 422. The first closure portion 420 is formed at and extends about the peripheral edge of the base 402 defined by the upper edges of the four side surfaces 412. The second closure portion 422 likewise is formed at and extends about peripheral edge of the cover 404.

Figure 24:
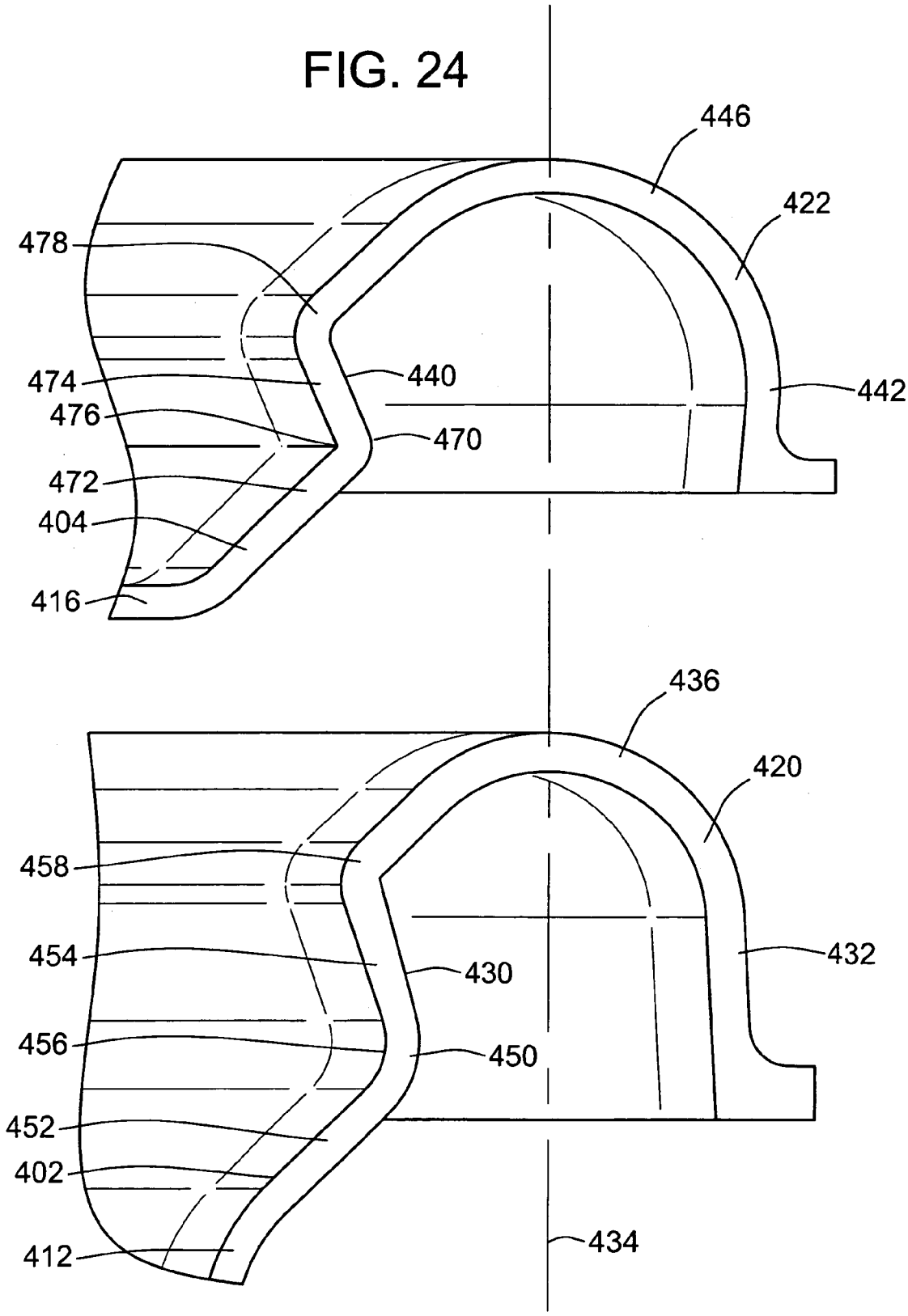
FIG. 24 is a detailed view of the area indicated in FIG. 23 illustrating another embodiment of the first and second closure portions disengaged and separated from each other.
Figure 25:
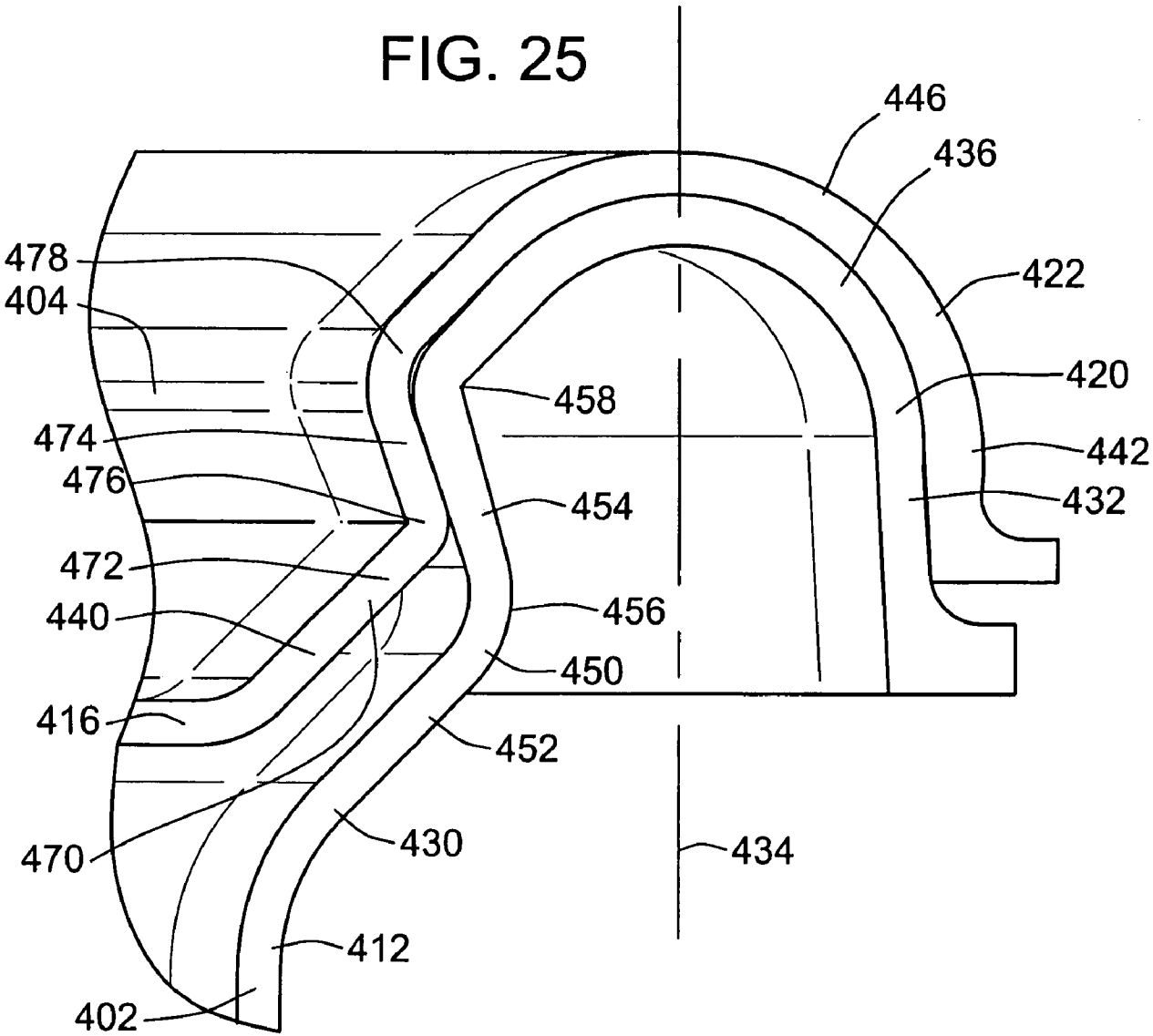
FIG. 25 is a detailed view of the area indicated in FIG. 23 illustrating the first and second closure portions fully engaged.

Referring to FIGS. 24 and 25, the first and second closure portion 420, 422 are both formed as a U-shaped skirt extending about the peripheral edge of the respective base 402 and cover 404. The first closure portion 420 includes an inner wall 430 extending vertically from the upright side surfaces 412 and a spaced-apart outer wall 432. Again, the terms "inner" and "outer" are made with respect to reference line 434. The inner and outer walls 430, 432 are connected by an upward curving intermediate wall 436. Like the first closure portion 420, the second closure portion 422 also includes an inner wall 440 and a spaced-apart outer wall 442 which are interconnected by an intermediate wall 446.

To engage the first and second closure portions 420, 422, the first closure portion is inserted between and gripped by the inner and outer walls 440, 442 of the second closure portion. As will be appreciated, when the first closure portion 420 is inserted into the second closure portion 422, the size differences cause the second closure portion to compressibly grip the first closure portion. The first and second intermediate walls 436, 446 may have a resilient characteristic that provides and transmits the gripping force to the inner and outer walls.

To releasably interlock the first and second closure portions 420, 422 when engaged, the first and second inner walls 430, 440 include a respective first and second cutback portion 450, 470. The first cutback portion 450 is shaped as a shallow generally V-shaped notch formed by a first outwardly directed leg 452 that extends from the upright side surface 412 that intersects a first inwardly directed leg 454 extending from the curved intermediate wall 436. The intersection of the first and second legs 452, 454 creates an outwardly directed trough 456. Additionally, the intersection of the second leg 454 and the intermediate wall 436 creates an inwardly directed ridge 458. Similarly, the second cutback portion 470 is shaped as a generally V-shaped notch formed by a second outwardly directed leg 472 and a second inwardly directed leg 474 that intersect to provide a second outwardly directed trough 476. Also, the second inwardly directed leg 474 intersects the intermediate wall 436 to create an inwardly directed ridge 478.

When the first and second closure portions are in the fully engaged position, as illustrated in FIG. 25, the first and second cutback portions align and abut against each other. It will be appreciated that aligning and adjoining the cutback portions in the foregoing manner interlocks the closure portions and resists detachment of the cover from the base. To facilitate engagement of the closure portions, the intermediate walls 436, 446 can have a flexible, resilient characteristic that allows the inner walls 430, 440 and outer walls 432, 442 to displace during insertion of the first closure portion into the second closure portion. The flexible, resilient characteristic also provides the compressive gripping force holding the closure portions together.

Designing the closure portions 420, 422 of the present embodiment in the foregoing manner facilities simplified attachment of the base 402 and cover 404, for example, by enabling engagement via a downward push applied to the center of the cover. For instance, referring to FIGS. 21 and 23, the flat, horizontal surface 416 of the cover 404 presents no obstacles that would otherwise hinder the engagement forces from radiating outward to the closure portions 420, 422. Additionally, the corners of the base 402 and cover 404 are rounded or curved. It will be appreciated that rounded corners facilitate a more even distribution of closure forces over the closure portions than as opposed to sharp corners. The advantage of this effect can be further exploited in other embodiments by forming the base and cover in a circular shape.

At the closure portions 420, 422, as illustrated in FIGS. 24 and 25, it can be seen that the slanted second inwardly directed leg 472 of the second closure portion 470 functions to guide the first closure portion 420 between the second inner and outer walls 440, 442 of the second closure portion 422 during insertion. Additionally, the second outer wall 442 is directed outward in a sliding manner by the curved, semicircular shape of the first intermediate wall 436. Guiding the inner and outer walls in the foregoing manner lessens resistance to the engagement or closure forces required to engage the closure portions. Additionally, because only one cutback portion 450, 470 is provided on each of the inner walls 430, 440, the force necessary to engage the closure portions 420, 422 is reduced. Finally, because the first and second outer walls 432, 442 are smooth, vertically straight structures, the outer walls can easily slide over each other during insertion. Hence, the base 402 and cover 404 are capable of being fully engaged by a simple push applied to the center of the cover. It should also be appreciated that, by providing a single cutback portion on each of the inner walls, only a single audible and/or tactile indication will be provided when the closure portions 420, 422 are engaged. For example, referring to FIG. 25, a seal is created by contact between the inwardly directed legs 454, 474. The contact location facilitates the sealing effect that helps preserve food items stored in the container and prevents leakage or spillage from the container.

Another advantage of having intermediate walls 436, 446 and outer walls 432, 442 as shown in FIG. 25 is that they may provide a either a continuous or a discontinuous contact surface facilitating a circuitous path to help prevent contents from leaking.

Figure 26:
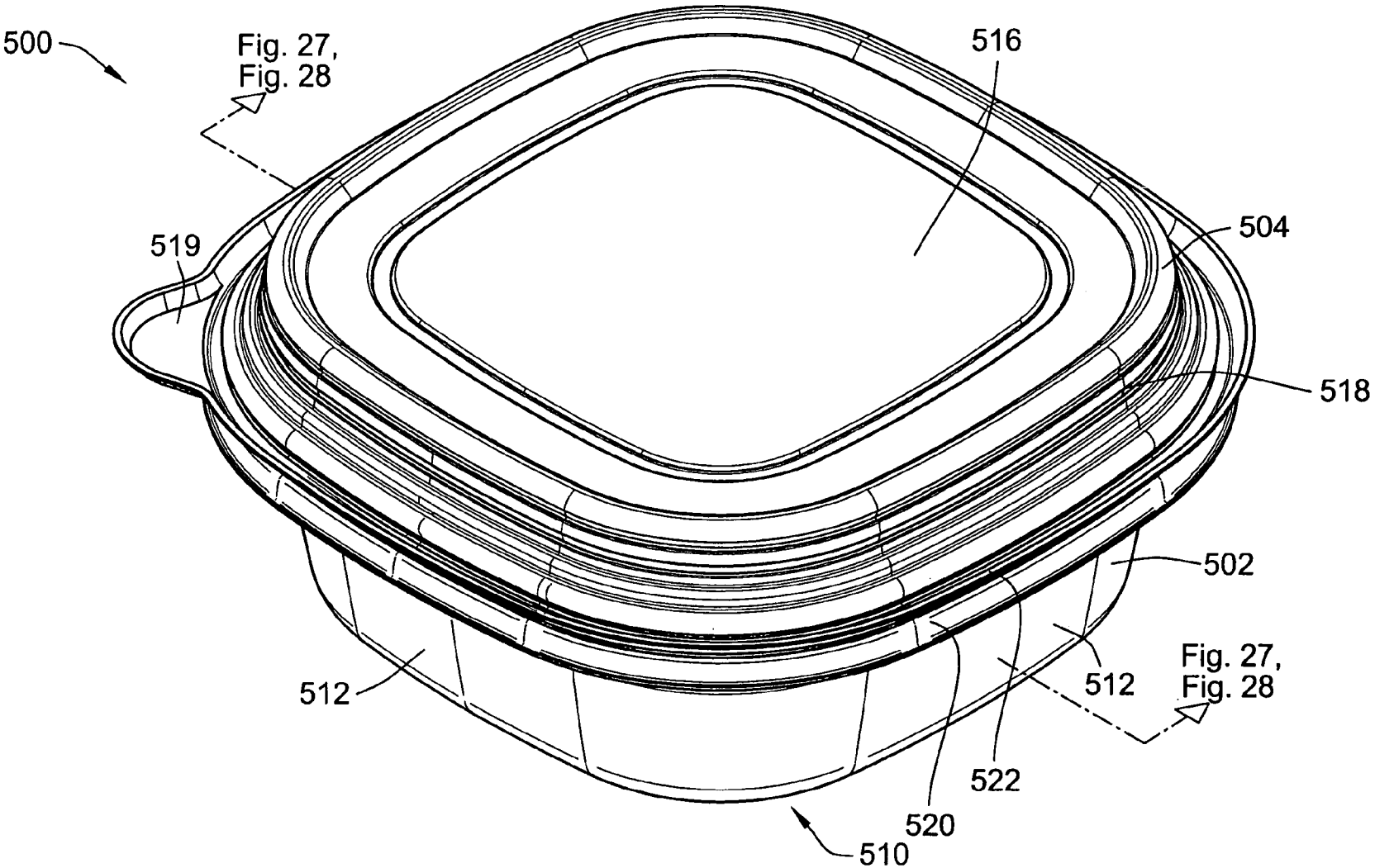
FIG. 26 is a top perspective view of another embodiment of a container having a base and an attached cover designed in accordance with the teachings of the invention.
Figure 27:
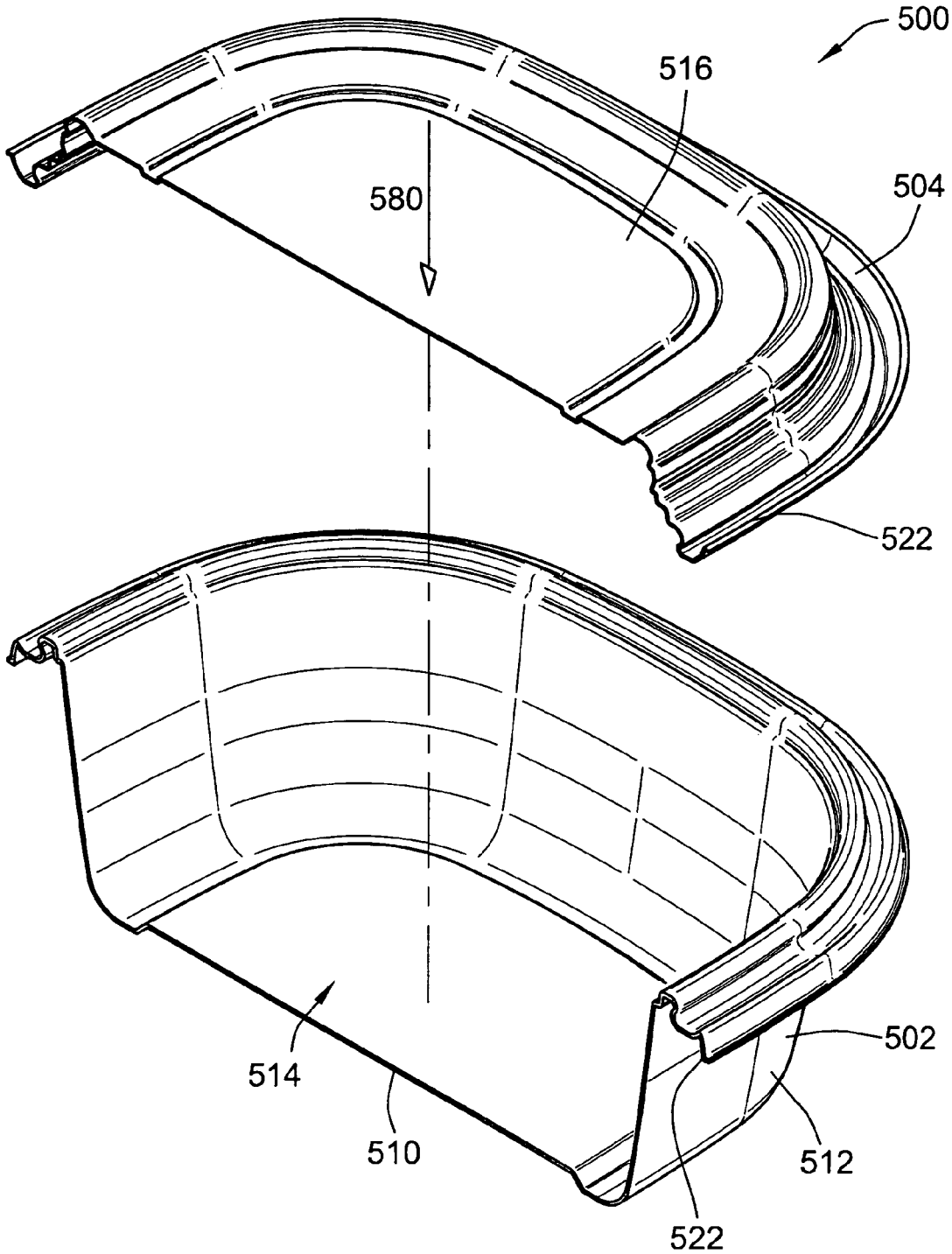
FIG. 27 is a perspective, cross-sectional view taken along line 27-27 of FIG. 26 illustrating the cavity defined by the base and the detached cover.
Figure 28:
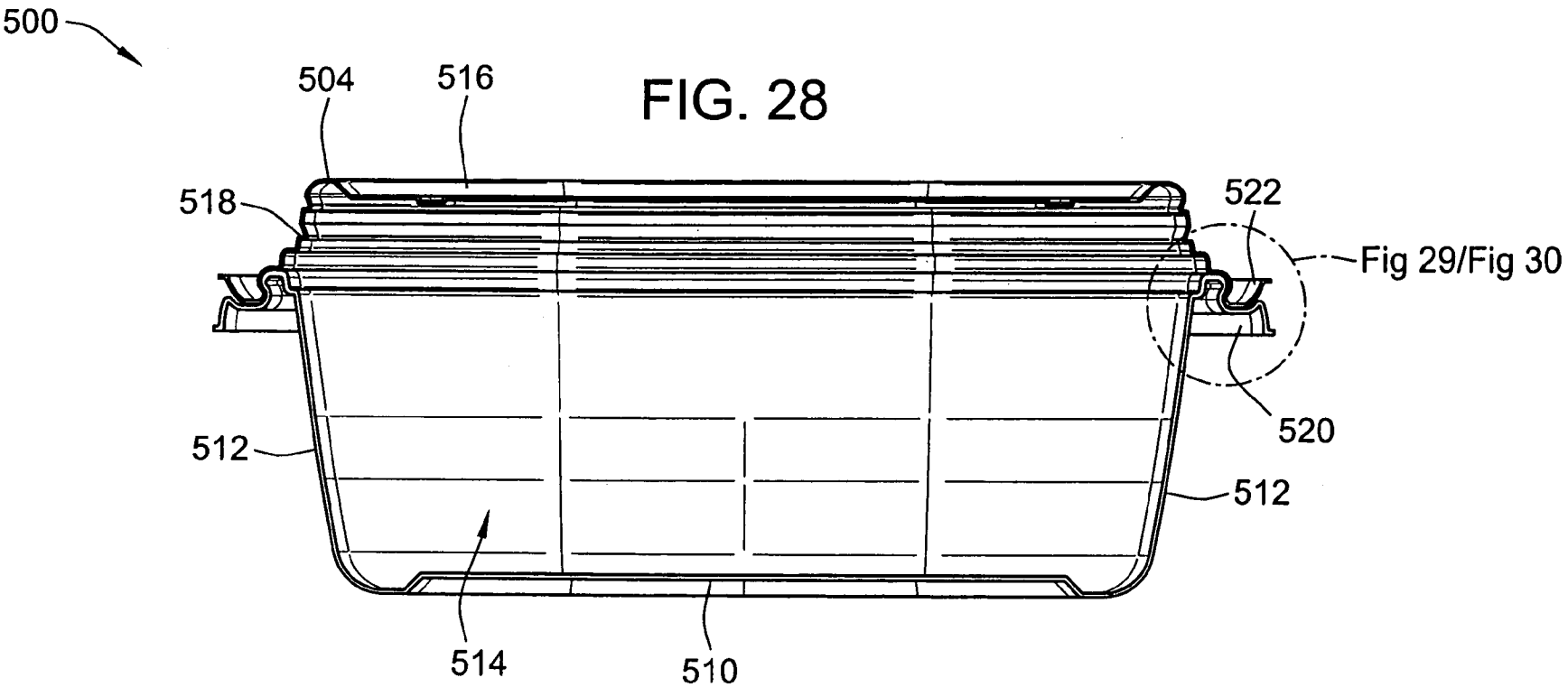
FIG. 28 is a side elevational view of the cross-section taken along line 27-27 of FIG. 26 illustrating the base and cover attached by engagable closure portions.

Referring to FIGS. 26, 27, and 28, there is illustrated another embodiment of container 500 having a base 502 and a detachable cover 504. The illustrative base 502 includes a horizontal bottom surface 510 and four upright side surfaces 512 that define a cavity 514 into which food items can be placed. To provide a head space for the cavity 514, the cover 504 is a shell having a generally horizontal top surface 516 that is supported by a downward-extending skirt 518. Of course, in other embodiments, the cover 504 including the top surface 516 and skirt 518 can have other suitable shapes. To enclose the cavity 514, the cover 504 can engage the base 502. To simplify detaching the cover 504 from the base 502, a removal tab 519 can be provided projecting from a corner of the cover. To releasably attach the base 502 and cover 504, the base and cover include a respective first and second closure portions 520, 522. The first closure portion 520 is formed at and extends about the peripheral edge of the base 502 defined by the upper edges of the four side surfaces 512. The second closure portion 522 is formed at and extends about the bottommost edge of the downward skirt 518.

Figure 29:
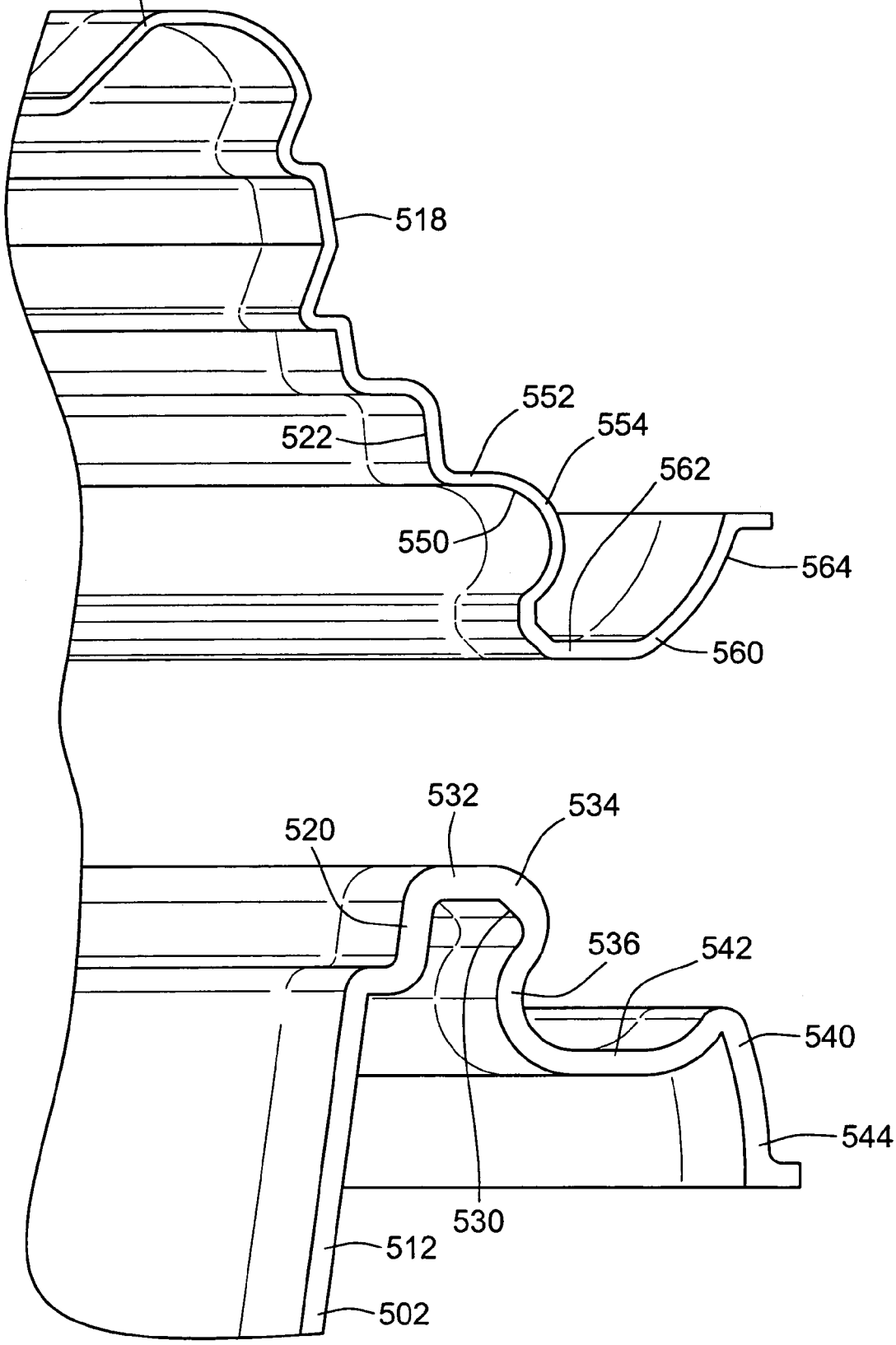
FIG. 29 is a detailed view of the area indicated in FIG. 28 illustrating another embodiment of the first and second closure portions disengaged and separated from each other.
Figure 30:
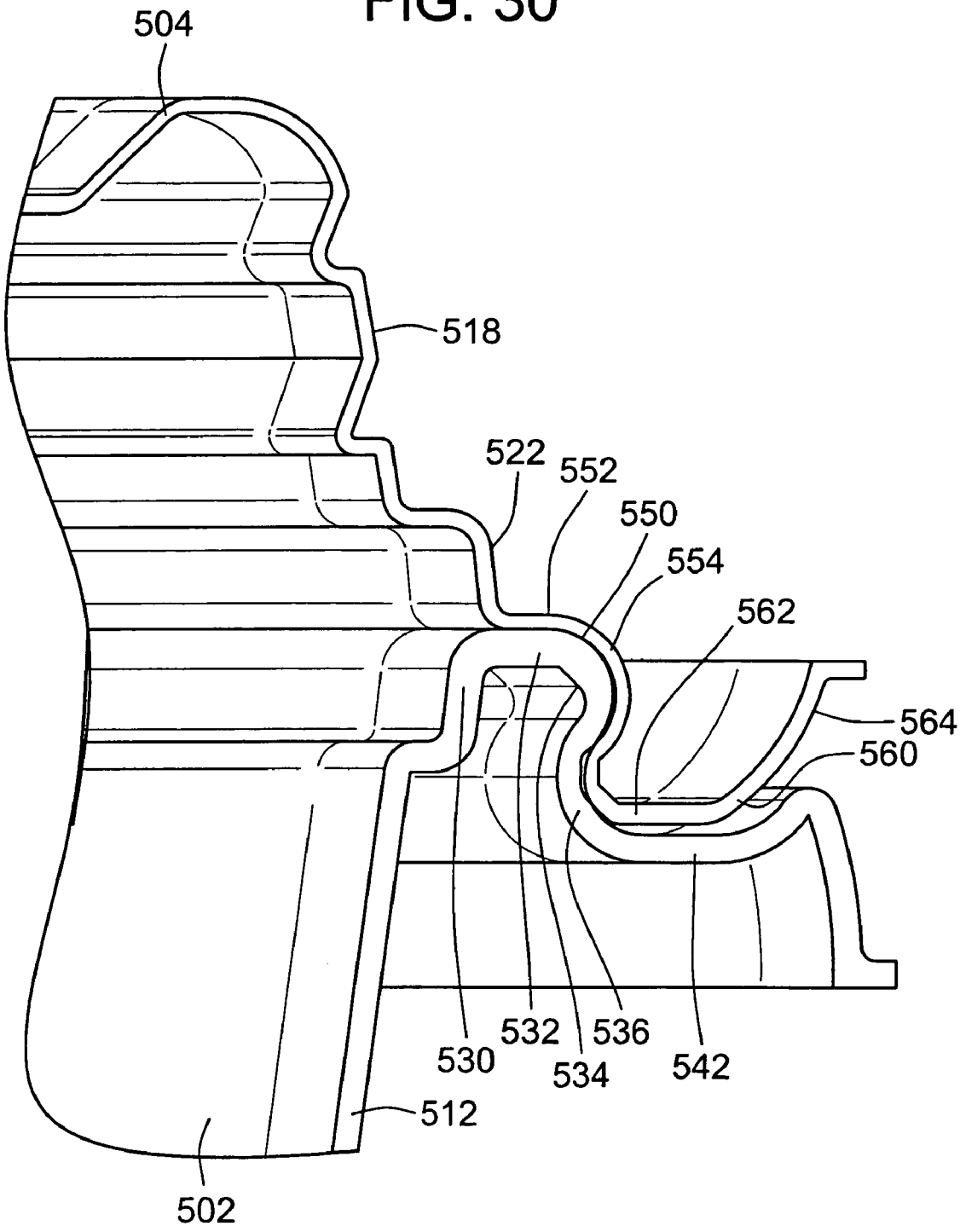
FIG. 30 is a detailed view of the area indicated in FIG. 29 illustrating another embodiment of the first and second closure portions fully engaged.

Referring to FIGS. 29 and 30, the first closure portion 520 includes a sealing portion 530 connected to the upright side surface 512 and an integrally formed, outwardly directed flange 540. Likewise, the second closure portion 522 includes a second sealing portion 550 connected to the downward skirt 518 and an integral, outwardly directed second flange 560.

To interlock and seal the first and second closure portions 520, 522 together, the first sealing surface 530 includes a horizontal ledge or leg 532 extending from the upright side surface 512 and an outward protruding ridge 534 formed at the end of the horizontal leg. Connected to and generally below the ridge 534 is a first generally curved, first cutback portion 536. The second sealing portion 550 also includes a second horizontal ledge or leg 552 extending from the downward skirt 518 and a second cutback portion 554 located generally below the second horizontal leg. When the first and second closure portions 520, 522 are pressed together, the second cutback portion 554 slides past the ridge 534 to align and abut with the first cutback portion 536. As will be appreciated by those of skill in the art, aligning and adjoining the cutback portions in the foregoing manner interlocks the closure portions and resists detachment of the cover from the base. Furthermore, as illustrated in FIG. 28, when the first and second cutback portions 536, 554 are thus adjoined, the first horizontal leg 532 and second horizontal leg 552 adjacently contact each other to seal the cavity 514 against leakage.

Additionally, because only a single cutback portion is included on each closure portion, the force necessary to engage the closure portions is substantially reduced. Referring to FIG. 27, the first and second closure portions 520, 522 can be engaged by applying a simple downward force or push (indicated by arrow 580) to the center of the horizontal surface 516 of the cover 502. It should also be appreciated that, by providing a single cutback portion on each of the inner walls, only a single audible and/or tactile indication will be provided when the closure portions 520, 522 are engaged.

Referring back to the first and second flanges 540, 560 illustrated in FIGS. 29 and 30, each flange includes a respective third and fourth horizontal leg 542, 562 extending outwardly from the respective first and second cutback portions 536, 554. Additionally, each flange 540, 560 includes a respective first and second diverging leg 544, 564 continuing from the third and fourth horizontal legs 542, 562. When the first and second closure portions 520, 522 are engaged, the first and second horizontal legs 542, 562 adjacently contact each other to provide further sealing while the first and second diverging legs 544, 564 diverge away from each other. As will be appreciated from FIGS. 29 and 30, a user can place his or her fingers between the first and second diverging legs 544, 564 to grasp and pull the legs in opposite directions and thereby pry the base 502 and cover 504 apart. Hence, the embodiment provides for simplified opening of the container even if the removal tab 519 illustrated in FIG. 26 is eliminated.

The container of any of the foregoing embodiments can be made from any suitable material including, for example, clarified polypropylene homopolymer. Additionally, the container can be made from clarified random copolymer polypropylene material. Other materials suitable for fabricating the container include PS (polystyrene), CPET (crystalline polyethylene terephthalate), APET (amorphous polyethylene terephthalate), LDPE (low density polyethylene), HDPE (high density polyethylene), PVC (polyvinyl chloride), PC (polycarbonate), and foamed polypropylene.

The material of the container can be clear or translucent to enable viewing of the container's contents. In various embodiments, the container can include a visual indication indicating that the first and second closure portions are properly engaged to effect a seal. For example, the visual indication can be provided by applying a first color on the first closure portion and a second color on the second closure portion that produce a third color when the first and second closure portions are engaged.

The container can be fabricated in any suitable manner including, for example, thermoforming, injection molding, or vacuum molding. Additionally, the container can be manufactured such that the cavity defined by the base includes one or more integrally formed partitions that divide the cavity to compartmentalize the container.

The base and cover of the container can be fabricated from a sheet of material of any of the foregoing types. The foregoing characteristics allow the container to be viewed as a single use, disposable item or to be readily reused multiple times.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A container comprising:

a base having a continuous base bottom with a central axis and a base wall extending from the base bottom upward from a base wall bottom to a base wall top and including at the base wall top a first closure portion of generally U-channel configuration having an inner wall closest to the central axis and a spaced-apart outer wall furthest from the central axis and a first intermediate wall connecting the inner wall and the outer wall, the inner wall including a generally ridged portion defined by a first upper cutback portion and a second lower cutback portion, the base and first closure portion being formed as a single piece, wherein the first cutback portion and the second cutback portion are arranged vertically adjacent to each other such that extending from top to bottom a first upper leg of the first cutback portion directed downward towards the outer wall intersects a second lower leg of the first cutback portion directed downward away from the outer wall to create a first ridge directed towards the outer wall and a third upper leg of the second cutback portion directed downward towards the outer wall intersects a lower forth leg of the second cutback portion directed downward away for the outer wall to create a second ridge directed towards the outer wall; and a cover including a second closure portion of generally U-channel configuration having an inner wall and a spaced-apart outer wall and a first intermediate wall connecting the inner wall and the outer wall, the inner wall including a generally ridged portion defined by a third cutback portion and an optional forth cutback portion and the second closure portion engageable with the first closure portion to releasably attach the cover to the base, wherein the outer wall of the second closure portion extends downward from the first intermediate wall to form a first angled leg extending downwardly and inwardly towards the inner wall and the bottom of first angled leg protrudes outward forming a first outward step where the outer wall extends downward to form a second angled leg extending downwardly and inwardly towards the inner wall and the bottom of the second angled leg protrudes outward forming a flange.

2. The container of claim 1, wherein the outer wall of the first closure portion includes a first vertical leg protruding downwards to a first closure portion outer wall step.

3. The container of claim 1, wherein the second closure portion inner wall includes both a third cutback portion and a fourth cutback portion.

4. The container of claim 2, wherein the outer wall of the first closure portion includes a second vertical leg protruding downwards from the first closure portion outer wall step to an outward flange.

5. The container of claim 3, wherein the first and second closure portions are configurable in a fully engaged position wherein the first and third cutback portions align with and abut against each other and the second and fourth cutback portions align with and abut against each other.

6. The container of claim 5, wherein the first and second closure portions are configurable in an intermediately engaged position wherein the second and third cutback portions align with and abut against each other.

7. The container of claim 1, wherein the base includes a bottom surface and an upright side surface, the first closure portion extending about the peripheral edge of the base defined by the side surface.

8. The container of claim 1, wherein the base and cover are transparent.

9. A container comprising:

a base having a continuous base bottom with a central axis and a base wall extending from the base bottom upward from a base wall bottom to a base wall top and including at the base wall top a first closure portion of generally U-channel configuration having an inner wall closest to the central axis and a spaced-apart outer wall furthest from the central axis and a first intermediate wall connecting at the top of the inner wall and at the top of the outer wall, the inner wall including a generally ridged portion defined by a first cutback portion above a second cutback portion, the base and first closure portion being formed as a single piece; and a cover including a second closure portion, the second closure portion having an inner wall and a spaced-apart outer wall, the inner wall having a third cutback portion above a forth cutback portion, wherein the first cutback portion and the second cutback portion are arranged vertically adjacent to each other such that a first upper leg of the first cutback portion directed downward towards the outer wall intersects a second upper leg of the first cutback portion directed downward away from the outer wall to create a first ridge directed towards the outer wall and a third upper leg of the second cutback portion directed downward towards the outer wall intersects a forth lower leg of the second cutback portion directed downward away from the outer wall to create a second ridge directed towards the outer wall and the first upper leg intersects the first intermediate wall to create a ridge towards the central axis.

10. The container of claim 9, wherein the cover has a horizontal flat surface.

11. The container of claim 9, wherein the second closure portion includes a second intermediate wall, the second intermediate wall interconnecting the first inner wall and the first outer wall.

12. The container of claim 11, wherein the first and second closure portions are configurable in a fully engaged position wherein the first and third cutback portions align with and abut against each other and the second and fourth cutback portions align with and abut against each other.

13. The container of claim 1, wherein the first cutback portion is shaped as a generally shallow, V-shaped notch.

14. The container of claim 9, wherein the first cutback portion is shaped as a generally shallow, V-shaped notch.

15. The container of claim 1, wherein the inner wall of the first closure portion is connected to the intermediate wall by a first shoulder that slants on an approximately 45° angle between the inner and intermediate walls.

16. The container of claim 9, wherein the inner wall of the first closure portion is connected to the intermediate wall by a first shoulder that slants on an approximately 45° angle between the inner and intermediate walls.

* * * * *